US009518436B2

(12) United States Patent
Rios, III et al.

(10) Patent No.: US 9,518,436 B2
(45) Date of Patent: Dec. 13, 2016

(54) POSITIVE RETRACTION LATCH LOCKING DOG FOR A ROTATING CONTROL DEVICE

(71) Applicant: WEATHERFORD TECHNOLOGY HOLDINGS, LLC, Houston, TX (US)

(72) Inventors: Aristeo Rios, III, Houston, TX (US); James W. Chambers, Houston, TX (US); Thomas F. Bailey, Abilene, TX (US); Danny W. Wagoner, Cypress, TX (US); Simon J. Harrall, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/691,202

(22) Filed: Apr. 20, 2015

(65) Prior Publication Data

US 2015/0226025 A1 Aug. 13, 2015

Related U.S. Application Data

(62) Division of application No. 13/183,787, filed on Jul. 15, 2011, now Pat. No. 9,010,433.

(60) Provisional application No. 61/365,288, filed on Jul. 16, 2010.

(51) Int. Cl.

| | |
|---|---|
| ***E21B 23/01*** | (2006.01) |
| ***E21B 33/03*** | (2006.01) |
| ***E21B 33/038*** | (2006.01) |
| ***E21B 33/08*** | (2006.01) |

(52) U.S. Cl.

CPC ..... *E21B 23/01* (2013.01); *E21B 33/03* (2013.01); *E21B 33/038* (2013.01); *E21B 33/085* (2013.01); *Y10T 292/0964* (2015.04)

(58) Field of Classification Search

CPC ..... E21B 23/01; E21B 33/03; E21B 33/038; E21B 33/085

See application file for complete search history.

(56) References Cited

U.S. PATENT DOCUMENTS

| | | | | |
|---|---|---|---|---|
| 3,222,088 | A * | 12/1965 | Haeber | E21B 33/038 166/344 |
| 3,228,715 | A | 1/1966 | Neilon et al. | |
| 3,321,217 | A | 5/1967 | Ahlstone | |
| 3,675,713 | A | 7/1972 | Watkins | |
| 4,042,123 | A | 8/1977 | Sheldon et al. | |

(Continued)

FOREIGN PATENT DOCUMENTS

| | | | |
|---|---|---|---|
| WO | 2007136793 | A1 | 11/2007 |
| WO | 2010081621 | A2 | 7/2010 |

OTHER PUBLICATIONS

International Search Report issued Feb. 17, 2012 for PCT Patent Application No. PCT/IB2011/053175, 9 pages.

Mitten Opinion issued Feb. 17, 2012 for PCT Patent Application No. PCT/IB2011/053175, 11 pages.

(Continued)

*Primary Examiner* — James G Sayre

(74) *Attorney, Agent, or Firm* — Smith IP Services, P.C.

(57) ABSTRACT

A latch and method for use is provided for latching an item of oilfield equipment. The latch has a housing containing a latch member, and the latch member is movable between a radially engaged position in which it is engaged with the item of oilfield equipment, and a radially retracted position in which it is disengaged from the item of oilfield equipment. An actuator is configured to drive the latch member into the radially engaged position. Further, the actuator is configured to drive the latch member toward the radially retracted position.

12 Claims, 21 Drawing Sheets

(56) References Cited

U.S. PATENT DOCUMENTS

| | | | | |
|---|---|---|---|---|
| 4,222,592 | A | 9/1980 | Saliger et al. | |
| 4,273,372 | A | 6/1981 | Sheshtawy | |
| 4,433,859 | A * | 2/1984 | Driver | E21B 33/038 285/315 |
| 4,526,406 | A * | 7/1985 | Nelson | E21B 33/038 285/18 |
| 4,619,324 | A | 10/1986 | Couch | |
| 4,708,376 | A | 11/1987 | Jennings et al. | |
| 4,856,594 | A * | 8/1989 | Jennings | F16L 37/002 166/338 |
| 4,902,044 | A | 2/1990 | Williams et al. | |
| 5,328,180 | A * | 7/1994 | Benavides | B23B 31/40 166/206 |
| 6,012,516 | A | 1/2000 | Brunet | |
| 6,129,149 | A * | 10/2000 | Beall | E21B 33/038 166/344 |
| 6,234,252 | B1 | 5/2001 | Pallini, Jr. et al. | |
| 6,540,024 | B2 | 4/2003 | Pallini et al. | |
| 6,547,002 | B1 | 4/2003 | Bailey et al. | |
| 6,615,933 | B1 | 9/2003 | Eddison | |
| 8,474,537 | B2 * | 7/2013 | Voss | E21B 33/038 166/338 |
| 2001/0045286 | A1 | 11/2001 | Pallini et al. | |
| 2006/0108119 | A1 | 5/2006 | Bailey et al. | |
| 2009/0057012 | A1 | 3/2009 | Williams | |
| 2009/0139724 | A1 | 6/2009 | Gray et al. | |

OTHER PUBLICATIONS

Partial Search Report issued Nov. 10, 2011 for PCT Patent Application No. PCT/IB2011/053175, 7 pages.

* cited by examiner

POSITIVE RETRACTION LATCH LOCKING DOG FOR A ROTATING CONTROL DEVICE

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND

Oilfield operations may be performed in order to extract fluids from the earth. When a well site is completed, pressure control equipment may be placed near the surface of the earth. The pressure control equipment may control the pressure in the wellbore while drilling, completing and producing the wellbore. The pressure control equipment may include blowout preventers (BOP), rotating control devices, and the like.

The rotating control device or RCD is a drill-through device with a rotating seal that contacts and seals against the drill string (drill pipe, casing, drill collars, Kelly, etc.) for the purposes of controlling the pressure or fluid flow to the surface. For reference to an existing description of a rotating control device incorporating a system for indicating the position of a latch in the rotating control device, please see US patent publication number 2009/0139724 entitled "Latch Position Indicator System and Method", U.S. application Ser. No. 12/322,860, filed Feb. 6, 2009, the disclosure of which is hereby incorporated by reference. This publication describes a rotating control device having a latch system used for securing and releasing bearings and stripper rubber assemblies into and out of the housing for the rotating control device.

Prior latch systems have a tendency to jam, stick, catch or become lodged in an engaged position with the oilfield equipment. When the latch is jammed, oilfield equipment and/or the pressure control systems may become damaged. Further when the latch is jammed, rig time is lost to repair the damaged equipment. There is a need for more efficient latching and unlatching of items of oilfield equipment.

SUMMARY

A latch and method for use is provided for latching an item of oilfield equipment. The latch has a housing containing a latch member, and the latch member is movable between a radially engaged position in which it is engaged with the item of oilfield equipment, and a radially retracted position in which it is disengaged from the item of oilfield equipment. An actuator is configured to drive the latch member into the radially engaged position. Further, the actuator is configured to drive the latch member toward the radially retracted position.

As used herein the terms "radial" and "radially" include directions inward toward (or outward away from) the center axial direction of the drill string or item of oilfield equipment but not limited to directions perpendicular to such axial direction or running directly through the center. Rather such directions, although including perpendicular and toward (or away from) the center, also include those transverse and/or off center yet moving inward (or outward), across or against the surface of an outer sleeve of item of oilfield equipment to be engaged.

DETAILED DESCRIPTION OF EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
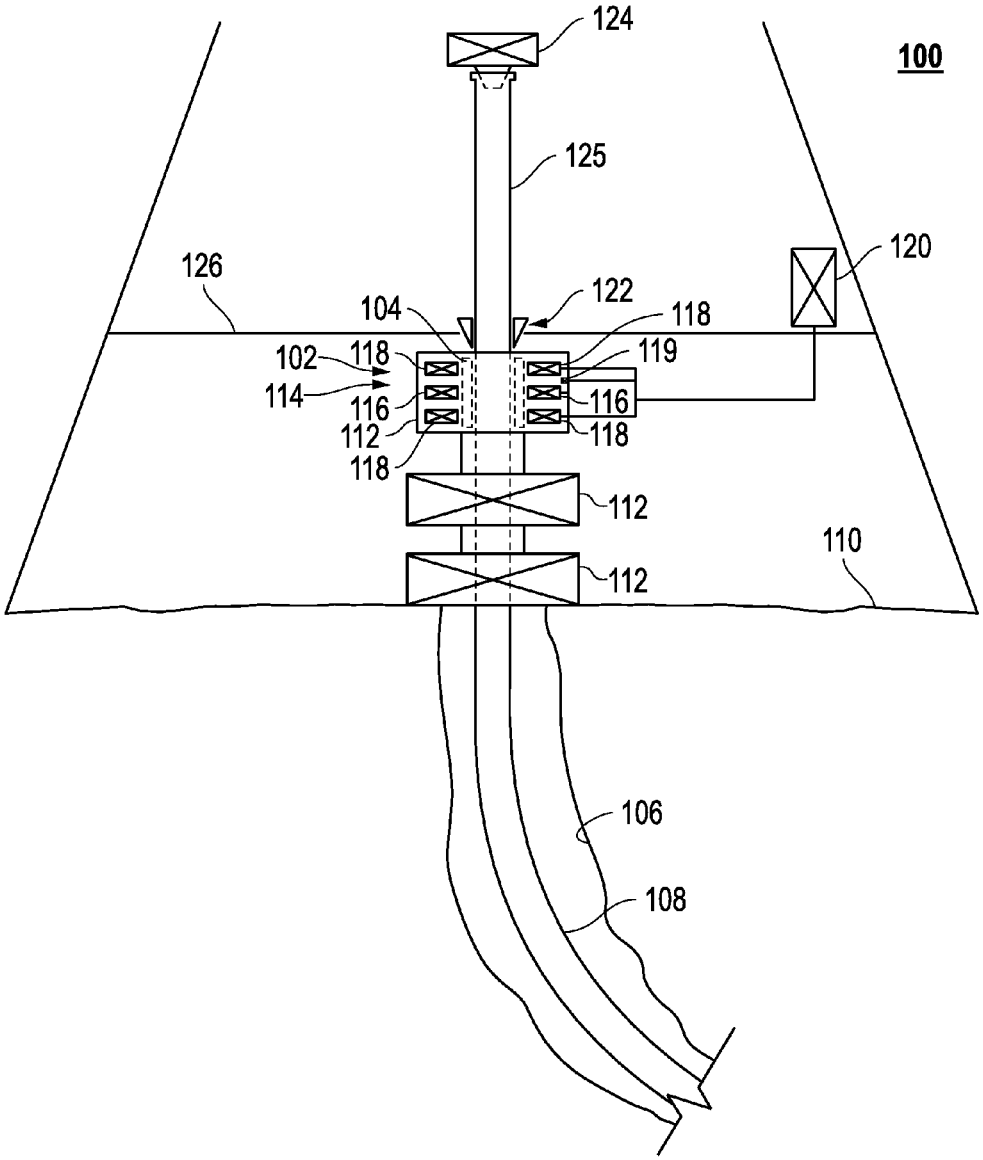
FIG. 1 depicts a schematic view of a wellsite.

FIG. 1 depicts a schematic view of a wellsite 100 having a latch 102 for latching to an item or piece of oilfield equipment 104. The wellsite 100 may have a wellbore 106 formed in the earth and lined with a casing 108. At the earth's surface 110 one or more pressure control devices 112 may control pressure in the wellbore 106. The pressure control devices 112 may include, but are not limited to, BOPs, RCDs, and the like. The latch 102 is shown and described herein as being located in a housing 114. The latch 102 may have one or more latch members 116 configured to engage the oilfield equipment 104. The latch 102 may have one or more actuators 118 configured to drive the latch into and out of engagement with the oilfield equipment 104. The latch 102 may further include one or more sensors 119 configured to identify the status of the latch 102.

The wellsite 100 may have a controller 120 for controlling the latch 102. In addition to controlling the latch 102, the controller 120, and/or additional controllers (not shown), may control and/or obtain information from any suitable system about the wellsite 100 including, but not limited to, the pressure control devices 112, the housing 114, the sensor(s) 119, a gripping apparatus 122, a rotational apparatus 124, and the like. As shown, the gripping apparatus 122 may be a pair of slips configured to grip a tubular 125 (such as a drill string, a production string, a casing and the like) at a rig floor 126, however, the gripping apparatus 122 may be any suitable gripping device. In addition, operation of the gripping apparatus 122 may be prevented when sensor(s) 119 detect that the latch 102 is in the radial engaged position. As shown, the rotational apparatus 124 is a top drive for supporting and rotating the tubular 125, although it may be any suitable rotational device including, but not limited to, a Kelly, a pipe spinner, and the like. The controller 120 may control any suitable equipment about the well site 100 including, but not limited to, a draw works, a traveling block, pumps, mud control devices, cementing tools, drilling tools, and the like.

Figure 2B:
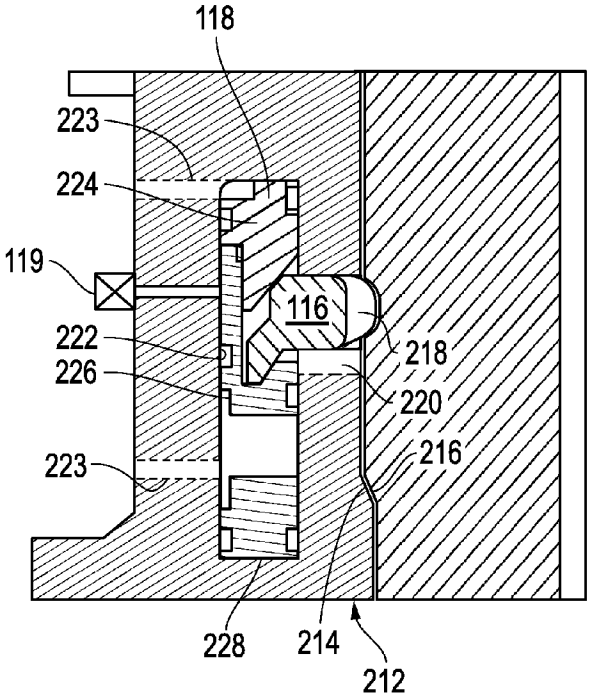
FIG. 2B depicts a cross-sectional view of a portion of a latch in the RCD according to an embodiment.
Figure 2A:
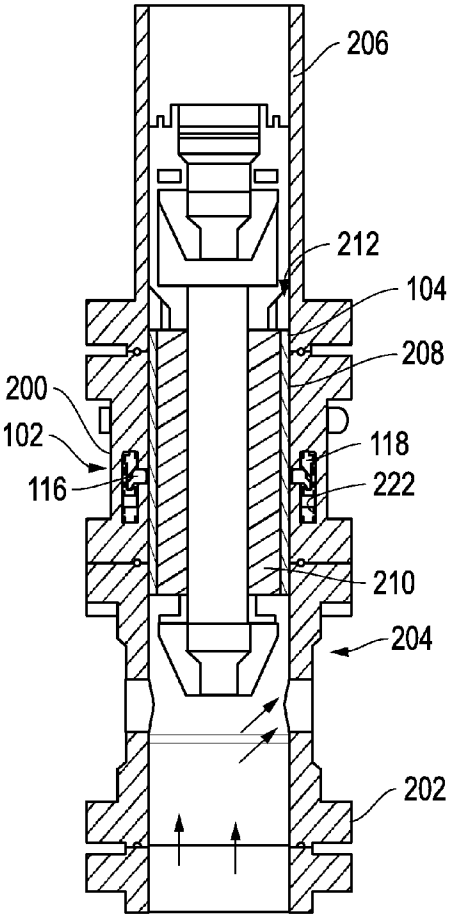
FIG. 2A depicts a cross-sectional view of an RCD according to an embodiment.

FIG. 2A depicts a cross sectional view of the housing 114 having the latch 102 according to an embodiment. The housing 114, as shown, has the latch member or "dog" 116, the one or more actuators 118, a latch housing 200 (or housing pieces), a bottom flange 202, a flow control portion 204, and an overshot mandrel 206. The latch 102 as shown is configured to latch to an outer sleeve 208 of a bearing 210. The latch 102 may secure the outer sleeve 208 in place while allowing the bearing 210 to rotate and/or absorb forces caused by rotating tubulars being run into and/or out of the wellbore 106. Although the latch 102 is shown and described as latching to an outer sleeve 208, it may latch to any suitable oilfield equipment including, but not limited to, an RCD, a bushing, a bearing, a bearing assembly, a test plug, a snubbing adaptor, a docking sleeve, a sleeve, sealing elements, and the like.

The bottom flange 202 may be for coupling the housing 114 to the other pressure control devices 112 (as shown in FIG. 1). The flow control portion 204 may be configured to control annular pressure in the housing 114 and/or the wellbore 106. The overshot mandrel 206 may be configured to receive and/or guide the tubular 125 (as shown in FIG. 1) as it enters the housing 114.

Figure 3:
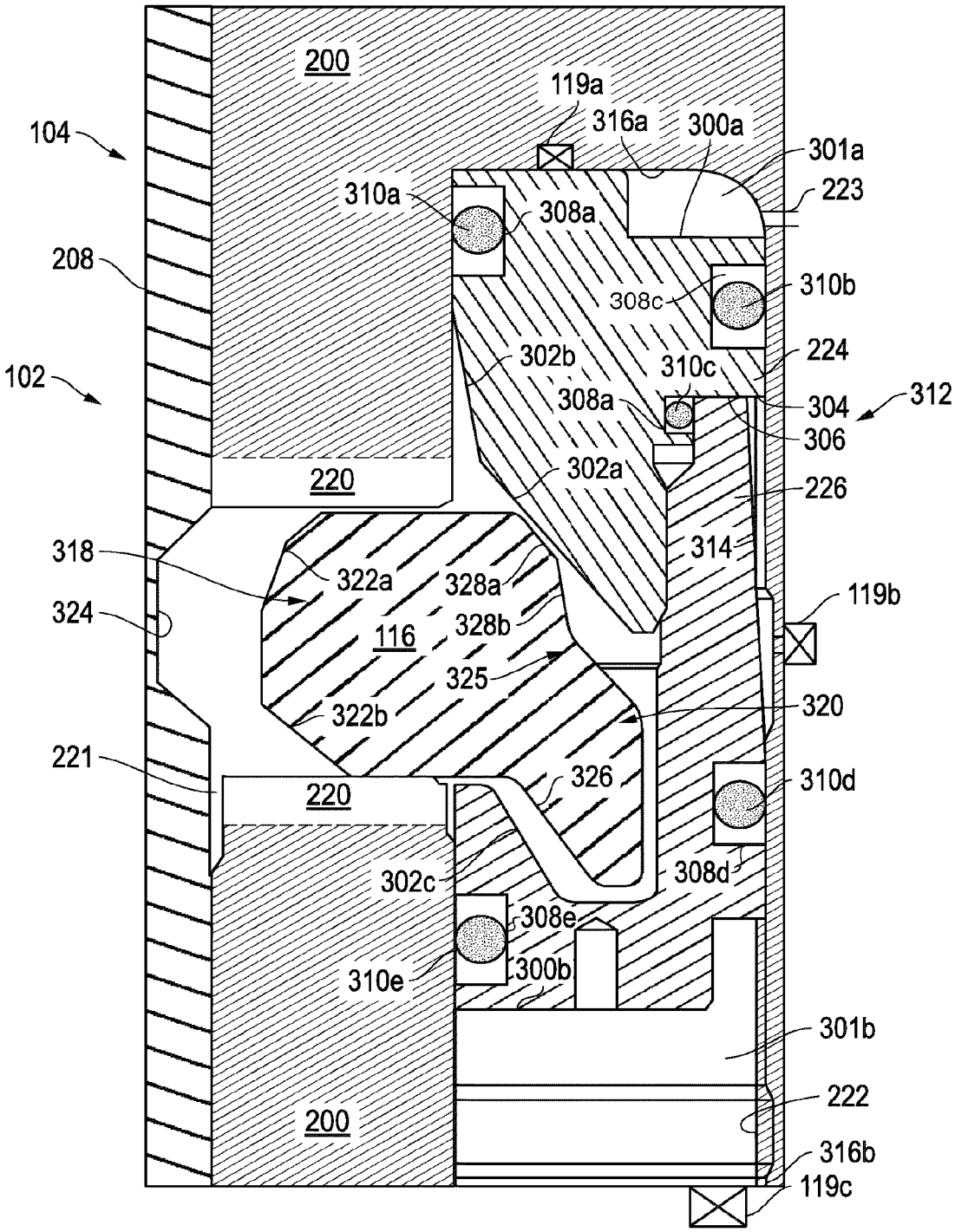
FIG. 3 depicts a cross-sectional view of a portion of the latch according to an embodiment.

The latch housing 200 as shown in FIG. 2A may define an opening 212 (or channel) for receiving the outer sleeve 208, or other oilfield equipment. The opening 212 may have an upset 214, or shoulder, (as shown in FIG. 2B) for receiving and/or supporting a matching profile 216 on the outer sleeve 208. The latch housing 200 may have an annular opening 218 therethrough that allows the latch member 116 to pass through the latch housing 200 and engage the outer sleeve 208. Referring to FIG. 3, the latch housing 200 may having one or more slots 220 formed across top and/or the bottom of the annular opening 218. The slots 220 may allow fluids to pass therethrough while the latch member 116 travels between an engaged position radially inward (or outward as case may be) and a disengaged position radially retracted or outward (or inward as case may be). In addition an annular slot 221 may be configured to allow fluids to move between the latch housing 200 and the outer sleeve 208 and/or oilfield equipment 104. The slots 220 and/or 221 function to relieve or inhibit the build-up of pressure and/or debris in spaces around the outside of the latch member 116. The source of such pressure and/or debris could be the wellbore pressure and/or a leaking seal.

The latch housing 200 may further define an actuator cavity 222. The actuator cavity 222 may be configured to substantially house the actuators 118. The actuator cavity 222 may have any number of ports 223 therethrough for supplying fluid pressure to the actuators 118. The fluid pressure may be pneumatic or hydraulic pressure. The actuator cavity 222 as shown is an annular cavity configured to house the actuators 118. The actuator cavity 222 may be in communication with the slots 220 and the annular opening 218 in order to allow the actuators 118 to move the latch member 116 between the engaged and disengaged positions. Although the latch housing 200 is shown having an annular opening 218 and the actuator cavity 222, it should be appreciated that the annular opening 218 may be several openings around the latch housing 200 and the actuator cavity 222 may be several cavities located around the latch housing 200 each housing separate actuators 118.

The actuators 118 are configured to actuate, or drive, the latch member 116 radially engaged and into engagement with outer sleeve 208, or other oilfield equipment. The actuators 118 are also configured to actuate, or drive, the latch member 116 radially outward and into the latch housing 200. As shown in FIG. 2B the actuators 118 comprise an engagement or first actuator 224, or engagement piston, and a disengagement or second actuator 226, or disengagement piston. Optionally the actuators 118 may have a secondary disengagement actuator 228. The engagement actuator 224 moves the latch member 116 toward the engaged position. The disengagement actuator 226 moves the latch member 116 into the disengaged position thereby allowing the outer sleeve 208, or oilfield equipment 104 to be removed from the housing 114. The secondary disengagement actuator 228 may be used to increase the removal force on the latch member 116 in the event the latch member 116 becomes stuck and/or jammed in the engaged position.

FIG. 3 depicts a blown up view of the latch 102 according to an embodiment. The latch member(s) 116 is in a position interposed with respect to the engagement actuator 224 and the disengagement actuator 226. The engagement actuator 224 as shown in FIG. 2B is an annular piston configured to move toward the latch member(s) 116 when the fluid pressure is applied to a piston surface 300*a* via the port 223. Fluid may enter a fluid chamber 301*a* and/or 301*b* in order to move the engagement actuator 224 and the disengagement actuator 226 respectively. The fluid may be hydraulic or pneumatic fluid. The engagement actuator 224 may have at least one ramp 302*a*, interface, or drive surface, to drive the latch member 116 radially inward toward the engaged position. The engagement actuator 224 as shown has two ramps 302*a* and 302*b* (which when impacting the one or more latch members 116 form contiguous interfaces therewith). The ramp 302*a* may have a steep incline relative to the latch member 116. The steep incline may increase the radial distance travelled by the latch member 116 with very little linear movement of the engagement actuator 224. Therefore, upon actuation of the engagement actuator 224, the latch member may quickly be moved to a location proximate the outer sleeve 208, or oilfield equipment 104. The ramp 302*a* may have an incline between twenty-five and fifty-five degrees. In another embodiment, the ramp 302*a* has an incline between thirty and forty degrees.

The ramp 302*b* may have a shallow incline relative to the latch member 116. The shallow incline may be configured to move the latch member 116 radially at a slower rate per the linear movement of the engagement actuator 224. The shallow incline may act as a self-lock on the latch member 116 (against, for example, wellbore pressure) if fluid pressure is lost on the piston surface 300*a*. The shallow incline may be between one and twenty degrees in an embodiment. In another embodiment, the shallow incline may be between nine and ten degrees. Although, the engagement actuator 224 is shown as having two ramps 302*a* and 302*b*, there may be any suitable number of ramps including one, two, three or more.

The engagement actuator 224 may have an engagement shoulder 304. The engagement shoulder 304 may be configured to be engaged by a nose 306 of the disengagement actuator 226. Therefore, the nose 306 of the disengagement actuator 226 may be used to apply force to the engagement actuator 224. When the force applied by the nose 306 is large enough to overcome the force applied on the engagement actuator 224 by the fluid pressure, the engagement actuator 224 will move linearly away from the latch member 116. This may free the latch member 116 to bias back toward the disengagement position, or be moved toward the disengagement position by the disengagement actuator 226. The engagement actuator 224 may have any number of seal pockets 308*a*, 308*b*, and 308*c* for housing seals 310*a*, 310*b* and 310*c*. The seals 310*a*, 310*b* and 310*c* may prevent fluid from passing between the surfaces of the engagement actuator 224, the latch housing 200, and/or the disengagement actuator 226.

The disengagement actuator 226 may have a piston surface 300*b* for motivating the disengagement actuator 226 toward the latch member 116 and/or the engagement actuator 224. The disengagement actuator 226 may have a ramp (interface, or drive surface) 302*c* (which when impacting the one or more latch members 116 form contiguous interfaces therewith) for engaging the latch member 116 and moving, retracting or driving, the latch member radially away from the outer sleeve 208, or oilfield equipment and into the disengaged position. As shown, the ramp 302*c* may have an incline between the steep and shallow incline of the engagement actuator 224, or an incline similar to the steep and/or shallow incline of the engagement actuator 22. In another embodiment, the disengagement actuator 226 may have two ramps (only one depicted) similar to the ramps 302*a* and 302*b* of the engagement actuator 224. The disengagement actuator 226 may have any number of seal pockets 308*d* and 308*e* for housing seals 310*d* and 310*e*. The seals 310*d* and 310*e* may prevent fluid from passing between the surfaces of the engagement actuator 224, the latch housing 200, and/or the disengagement actuator 226.

The disengagement actuator 226 may have a ram 312. The ram 312 may extend past the latch member 116 for engaging the engagement shoulder 304 with the nose 306. As fluid pressure is applied to the disengagement actuator 226, the nose 306 may engage the engagement shoulder 304 thereby moving the engagement actuator 224 away from the latch member 116. As the disengagement actuator 226 moves the engagement actuator 224, the ramps 302*a* and 302*b* may be disengaged from the latch member 116. The continued movement of the disengagement actuator 226 may engage the ramp 302*c* with the latch member 116 in order to directly and positively move/force the latch member 116 toward the disengaged position. Although the disengagement actuator 226 is shown as a separate piece from the engagement actuator 224, it should be appreciated that they may be integral.

The ram 312 may have a position ramp 314 located on one side. The sensor 119 may be used to determine the position or distance of/to the position ramp 314 relative to the latch housing 200. For example, the sensor 119 may be an optical sensor which determines the distance between the position ramp 314 and the sensor 119. By knowing the distance, the exact linear positions of the disengagement actuator 226 and the engagement actuator 224 may be determined. The location of the engagement actuator 224 and the disengagement actuator 226 may allow the operator and/or the controller 120 to determine the exact position of the latch member 116. Although the sensor 119 is described as being an optical sensor any suitable type of sensor may be used including, but not limited to, an infrared sensor, a mechanical sensor, a piston type sensor, a strain gauge, and the like.

Additional sensors 119 may be located about the latch housing 200 in order to determine the location of the actuators 118. For example, sensors 119*a* and 119*c* may be placed near a terminal end 316*a* and 316*b* of the actuator cavity 222. The sensors 119*a* and 119*c* may allow the operator and/or the controller 120 to determine if the engagement actuator 224 and/or the disengagement actuator 226 have reached the terminal ends 316*a* and 316*b* respectively. In addition, the volume, flow rate and/or the pressure of the fluid entering and/or leaving the fluid chambers 301*a* and/or 301*b* may be measured (or sensed proximate sensors 119) and optionally recorded in order to determine the location of the actuators 118.

The latch member 116 may have an engagement portion 318 and an actuator portion 320. The engagement portion 318 may have one or more profiles 322*a* and 322*b* configured to engage and secure to a matching profile 324 of the outer sleeve 208. Therefore, when the latch member 116 is in the engaged position, the one or more profiles 322*a* and 322*b* engage the matching profile 324 of the outer sleeve 208 thereby preventing the outer sleeve 208 from moving linearly in the housing 114. The incline of the one or more profiles 322*a* and 322*b* may self align the outer sleeve 208 as the latch member 116 moves toward the engaged position.

The actuator portion 320 may have an engagement edge 325 and a disengagement ramp 326. The engagement edge 325 may be a ramp or ramps, elliptical, a radius, or corner of the latch member that is engaged by the ramps (or correspondingly matched surfaces) 302*a* and/or 302*b* of the engagement actuator 224. As shown, the engagement edge 325 has two engagement ramps 328*a* and 328*b*. The ramps 328*a* and 328*b* may mirror the incline of the ramps 302*a* and 302*b*, or have another incline.

The disengagement ramp 326 may be configured to be engaged by the ramp 302*c* of the disengagement actuator 226. As shown, the disengagement ramp 326 protrudes into the actuator cavity 222. As the disengagement actuator 226 moves up the ramp 302*c* engages the disengagement ramp 326. Continued linear movement of the disengagement actuator 226 moves the latch member 116 toward the disengaged position via the disengagement ramp 326.

Figure 4:
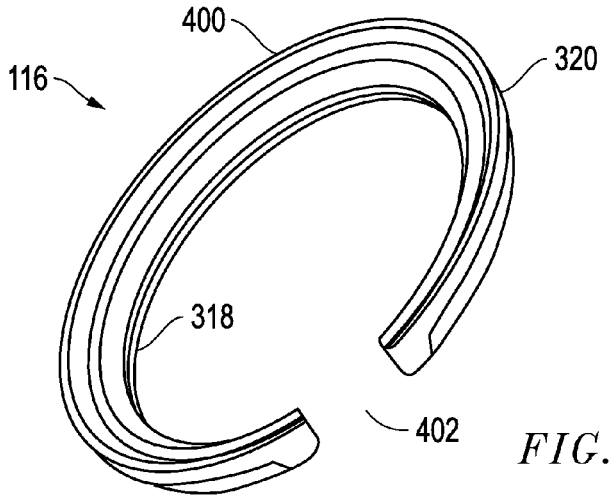
FIG. 4 depicts a perspective view of a latch member according to an embodiment.

FIG. 4 is a schematic perspective view of the latch member 116 according to an embodiment. As shown the latch member 116 is a C-ring 400. The C-ring 400 may have a gap 402 which is collapsed as the engagement actuator 224 moves the C-ring 400 toward the engaged position. The C-ring 400 may naturally be in the disengaged position. Therefore, as the engagement actuator 224 collapses the gap 402 and moves the latch member 116 toward the engaged position the latch member is biased toward the disengaged position. The C-ring acts as an energizable spring (i.e. such that the gap 402 enables the C-ring 400 to be squeezed in and to spring out. Therefore, typically when the engagement actuator 224 is moved clear of the latch member 116, the latch member 116 will move to the disengaged position. In addition to the slots 220 (as shown in FIG. 2) the C-ring 400 may have any number of slots, or ports therethrough to allow from fluid to pass as the C-ring 400 moves between the engaged and disengaged position. Although, the C-ring 400 is described as being biased toward the disengaged position, it should be appreciated that it may be biased toward the engaged position. Biasing the latch member closed may act as a fail-safe feature in the event that fluid pressure is lost on the engagement actuator 224, or piston while the oilfield equipment 104 and/or outer sleeve 208 are engaged. The closed bias would prevent the oilfield equipment 104 and/or outer sleeve 208 from becoming inadvertently released.

Figure 5:
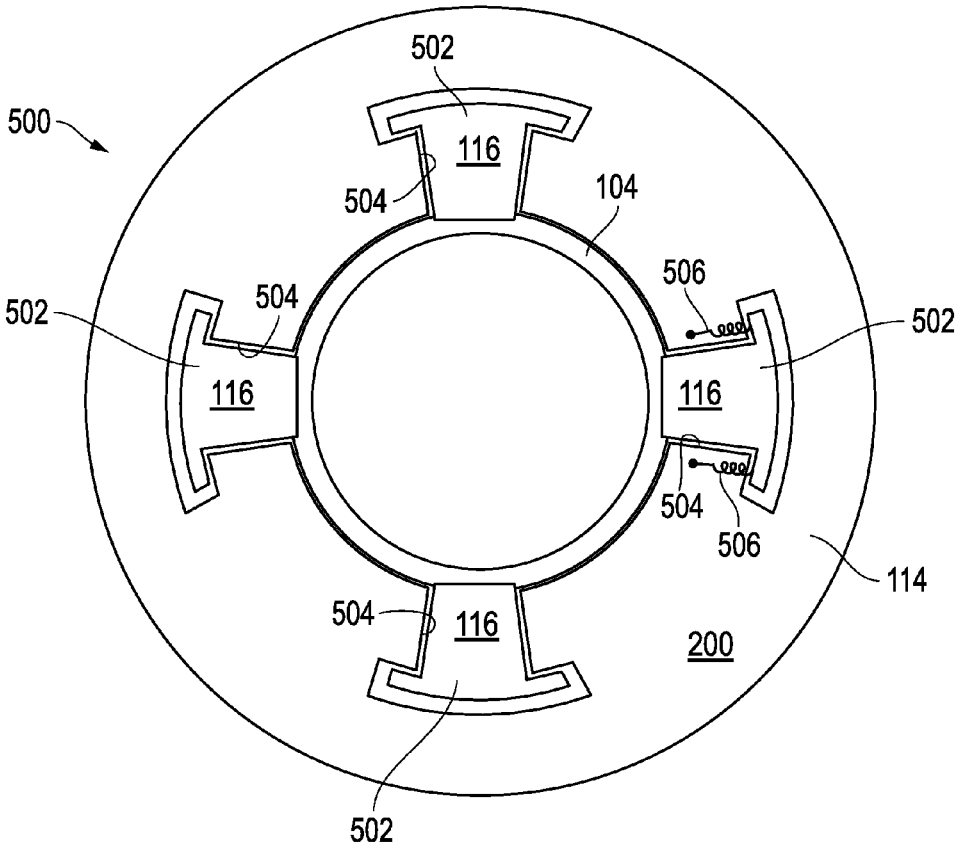
FIG. 5 depicts a schematic cross-sectional view of a latch according to an embodiment.

FIG. 5 depicts a schematic top view of an alternative latch member 500. The alternative latch member 500 may have several locking dogs 502 that move into engagement with the oilfield equipment 104 through a window 504 in the latch housing 200. The alternative latch members 500 may have several actuators 118 located radially about the latch housing 200, or there may be annular actuators as described above that engage each of the locking dogs 502. Any suitable actuator including those described herein may be used. The locking dogs 502 may have one or more biasing members 506 configured to bias the locking dogs 502 toward the disengaged position. The biasing member may be a coiled spring, a leaf spring, an elastomeric member, a fluid bias, and the like. It should be appreciated that the one or more biasing members 506 may be used in conjunction with any of the latch members 116 described herein. Further, the biasing member 506 may be used to bias the alternative latch member 500 toward the engaged position.

An operation of the latch 102 will now be described in conjunction with the Figures. FIG. 3 depicts the latch 102 in the disengaged position. In the disengaged position, the engagement actuator 224 may be against the terminal end of the actuator cavity 222. The latch member 116 may remain in the disengaged position due to the bias of the latch member 116. The sensors 119 may indicate that the engagement actuator 224 is in the disengaged position. In the disengaged position, the oilfield equipment 104, or outer sleeve 208 may optionally be moved into or out of the housing 114. The latch 102 may remain in the disengaged position until the operator and/or the controller 120 determine the oilfield equipment 104 is in position and needs to be latched.

Figure 6:
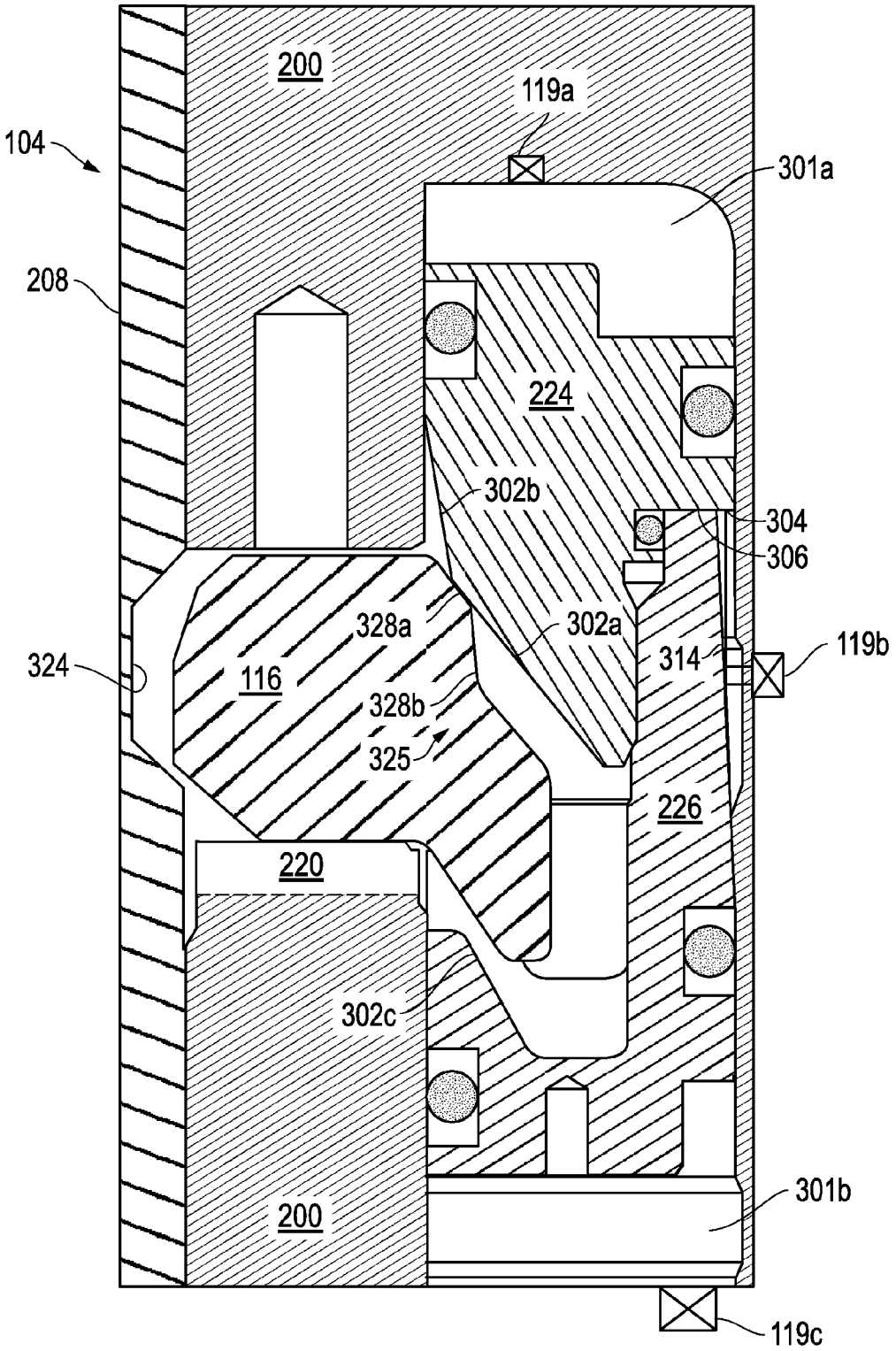
FIG. 6 depicts a cross-sectional view of an embodiment of a portion of the latch operating in an intermediate position.

FIG. 6 depicts the latch 102 in an intermediate position. The fluid pressure has been increased in the fluid chamber 301*a*. The increased fluid pressure moves the engagement actuator 224 into engagement with the engagement edge 325 of the latch member 116. The steep inclined ramp 328*a* may quickly move the latch member 116 toward the engaged position. The engagement shoulder 304 may engage the nose 306 of the disengagement actuator 226 thereby moving the disengagement actuator 226 clear of the latch member 116. The sensors 119*a* and 119*c* at the terminal ends of the actuator cavity 222 may indicate that the engagement actuator 224 and the disengagement actuator 226 are not in contact with the terminal ends. The sensor 119*b* may measure the exact location of the actuators 118.

Figure 7:
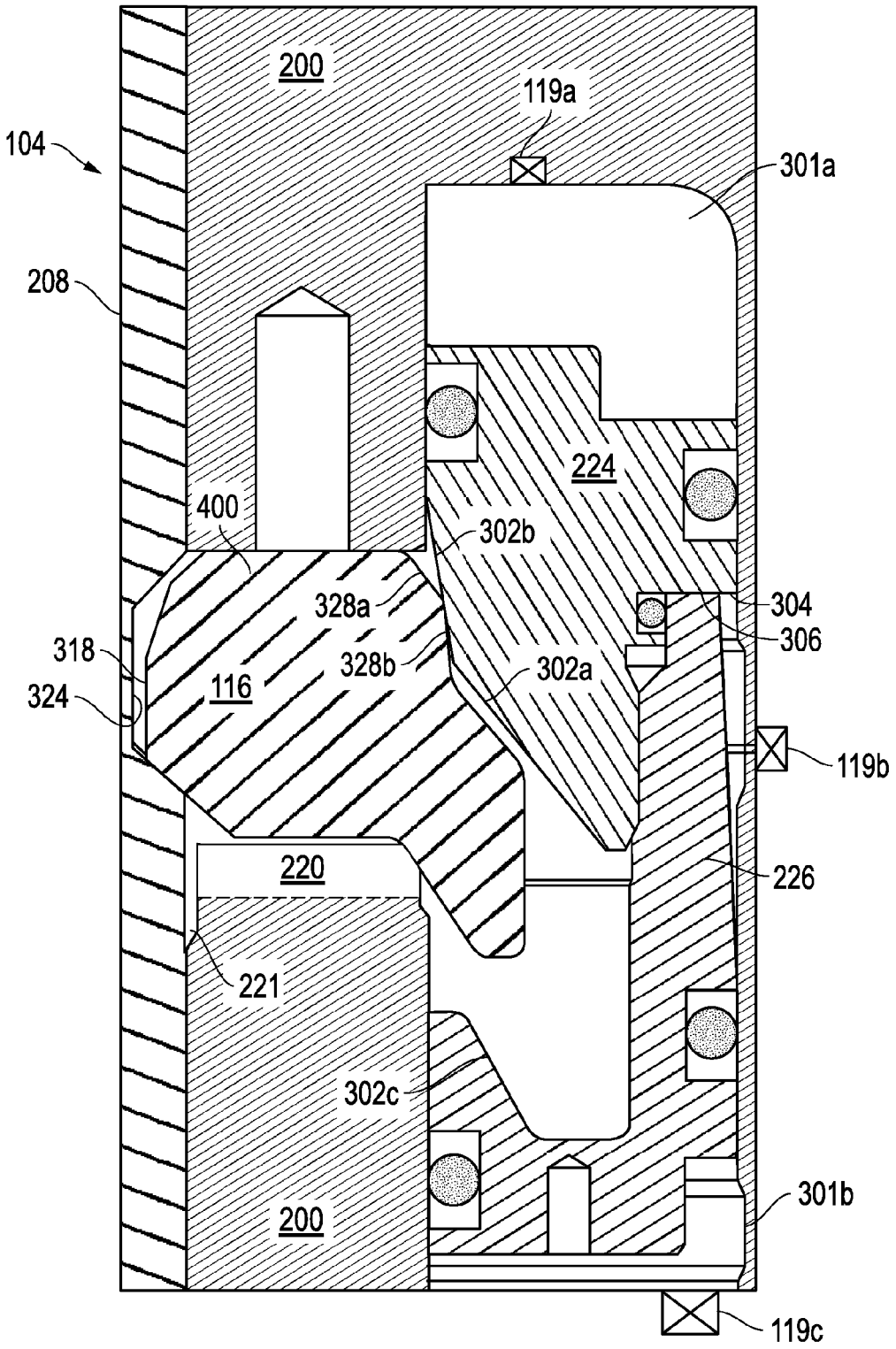
FIG. 7 depicts a cross-sectional view of an embodiment of a portion of the latch operating in an engaged position.

FIG. 7 depicts the latch member 116 engaging the outer sleeve 208 and/or the oilfield equipment 104. The engaging portion 318 may self align the outer sleeve 208 as the latch member 116 continues its radial inward travel. The C-ring 400 may compress the gap 402 (as shown in FIG. 4). The ramp 302*b* having a smaller incline may be engaged with the engagement ramp 328*b* thereby reducing the radial inward speed of the latch member 116 versus the engagement actuator 224. The continued linear movement of the engagement actuator 224 will slowly align the outer sleeve 208 and engage the latch member 116. The sensor 119*b* may continue to track the location of the actuators 118.

Figure 8:
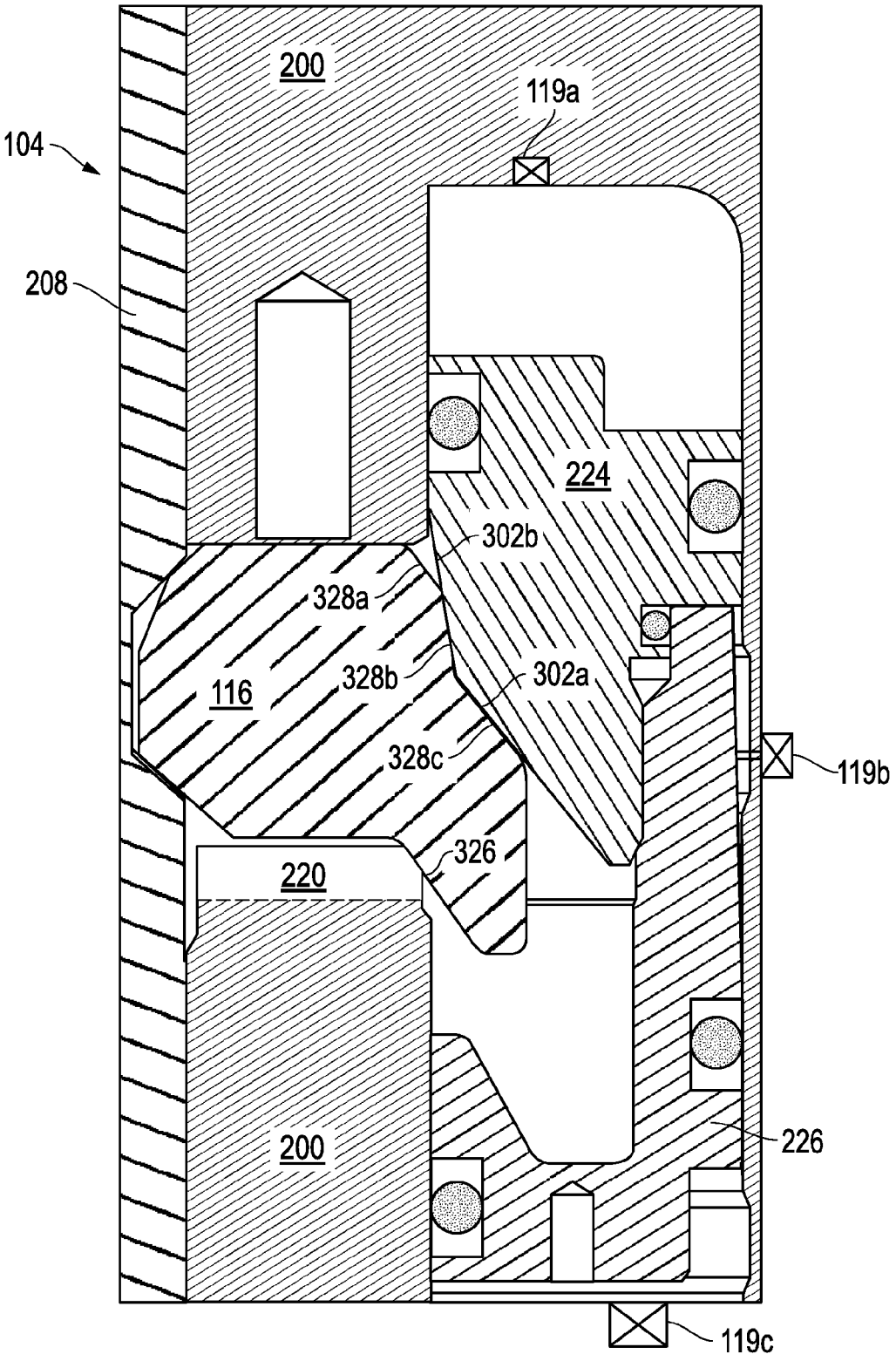
FIG. 8 depicts a cross-sectional view of an embodiment of a portion of the latch operating in a closed position but without engaging any suitable oilfield equipment.

FIG. 8 depicts the latch member 116 in the engaged position. In the engaged position, the engagement actuator 224 has moved latch member 116 radially inward as far as it may travel into engagement with the outer sleeve 208. As shown, the ramp 302*a* is engaged with the engagement ramp 328*c*, however, it should be appreciated that there may be a gap between these ramps. The disengagement actuator 226 may be engaged with the terminal end of the actuator cavity 222, or there may be a gap therebetween. The sensor 119*c* may detect the disengagement actuator 226 has reached the terminal end and thereby the engaged position. The sensor 119*b* may continue to track the location of the actuators 118 and thereby the latch member 116.

Figure 9:
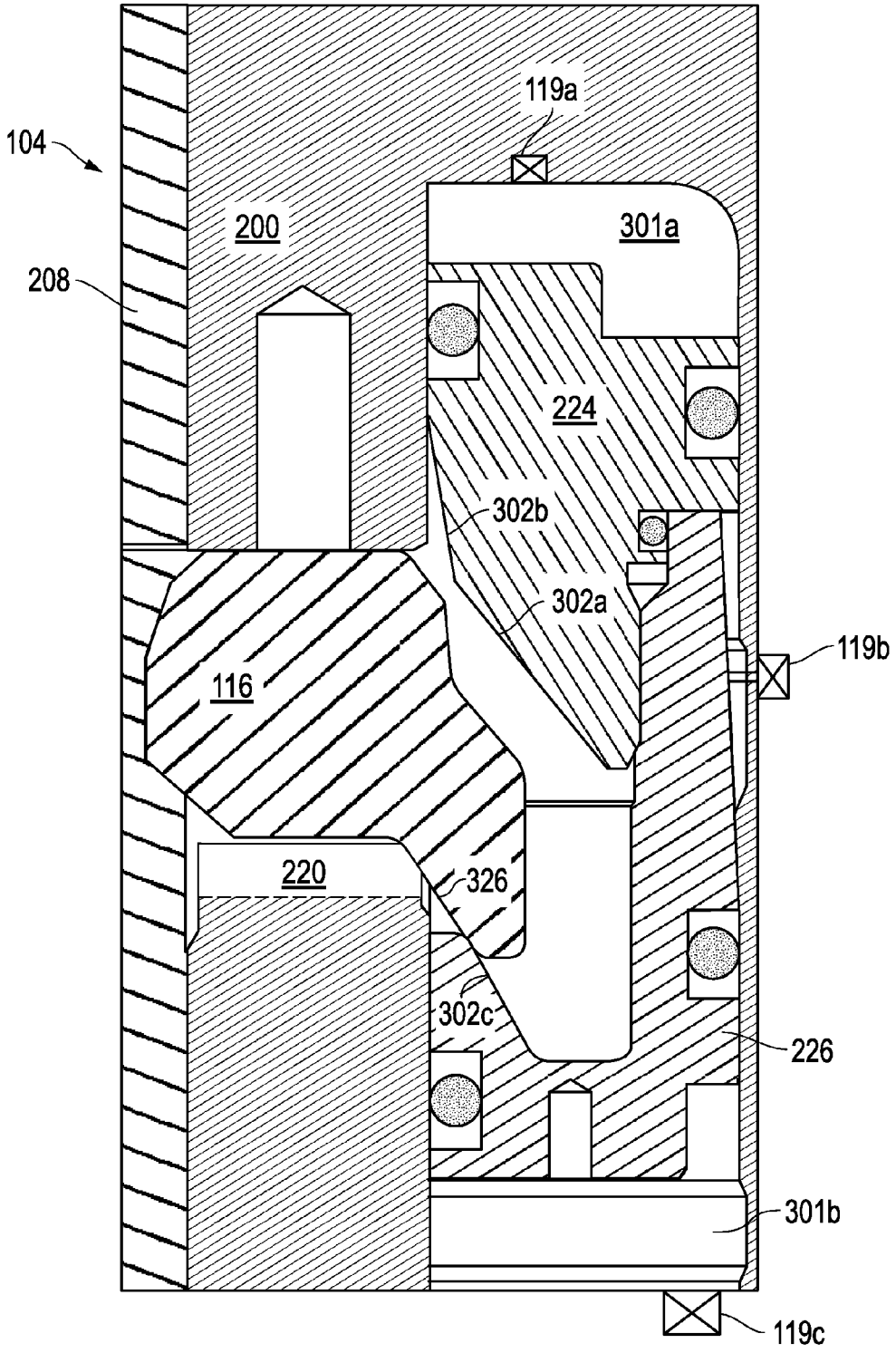
FIG. 9 depicts a cross-sectional view of an embodiment of a portion of a latch which has not self-released from the engaged or closed position.

FIG. 9 depicts a position wherein the latch member 116 is caught, stuck, held, jammed, wedged, stranded, or so impacted as that it will not spring to the disengaged position, or release position. The disengagement actuator 226 has moved the engagement actuator 224 clear of the latch member 116 with fluid pressure applied from the fluid chamber 301*b*. The latch member 116 however, has not moved, or sprung, to the disengaged position due to being caught, stuck, held, jammed, and/or wedged in the housing 200. Continued movement of the disengagement actuator 226 directly forces or engages the disengagement ramp 326 with the ramp 302*c* of the disengagement actuator 226. The ramp 302*c* then positively moves the latch member 116 radially outward toward the disengaged position with continued linear movement of the disengagement actuator 226. The sensor 119*b* may continue to track the location of the actuators 118 and thereby the latch member 116.

Figure 10:
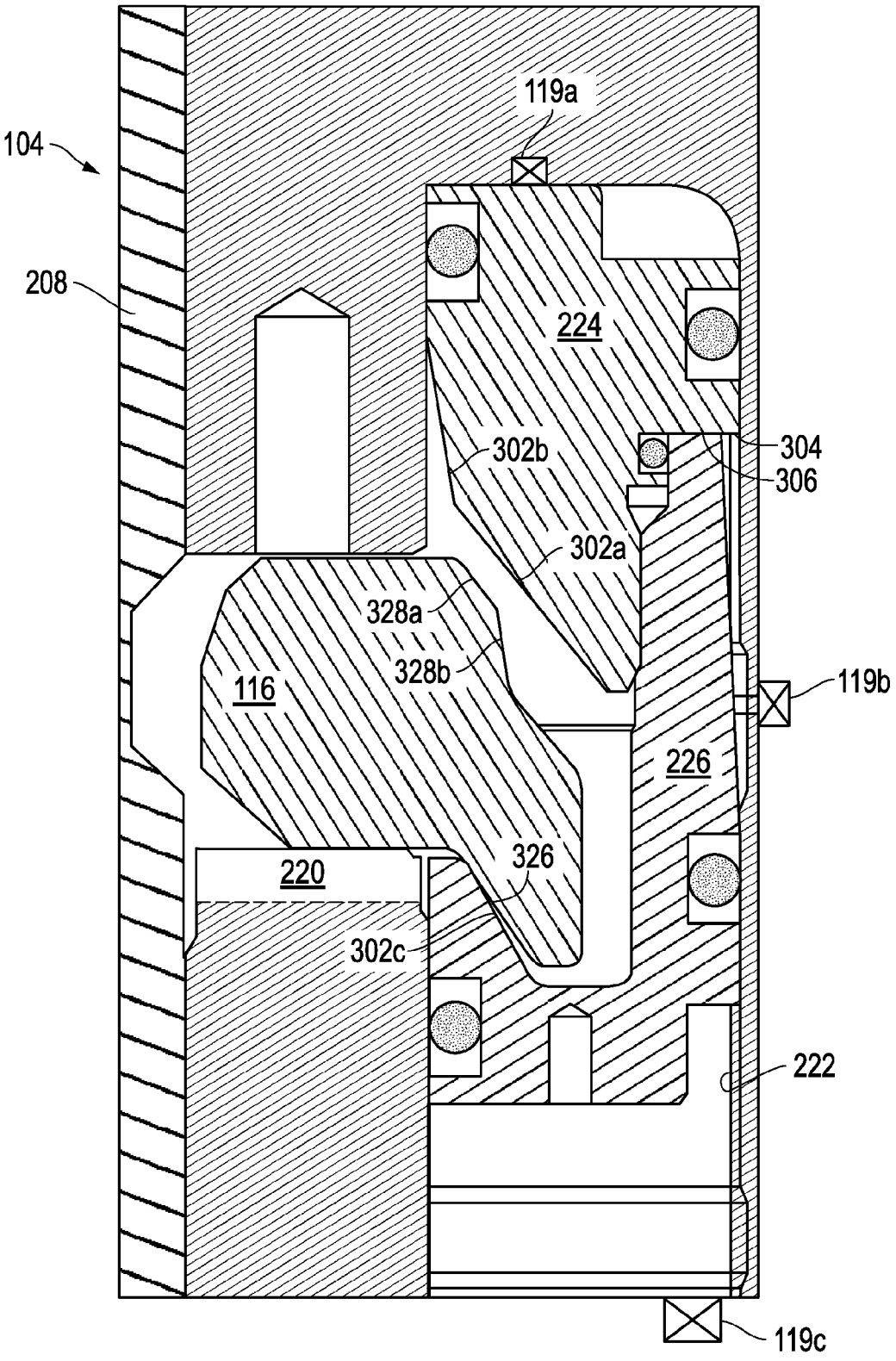
FIG. 10 depicts a cross-sectional view of an embodiment of a portion of the latch operating to positively drive the latch to the disengaged position.

FIG. 10 depicts the latch member 116 in the disengaged position after the disengagement actuator 226 has positively removed the latch member 116. In this position, the nose 306 of the disengagement actuator 226 has pushed the engagement shoulder 304 and thereby the engagement actuator 224 to the terminal end of the actuator cavity 222. The latch member 116 is in the disengaged position and is prevented from moving toward the engaged position by the disengagement ramp 326 and the ramp 302*c*. The sensor 119*a* may determine that the engagement actuator 224 has engaged the terminal end of the actuator cavity 222 and the sensor 119*b* may verify the position of the actuators 118. The latch 102 may remain in this position while the outer sleeve 208 and/or the oilfield equipment 104 is removed from the housing 114. The operator and/or the controller 120 may then place another piece of oilfield equipment 104 in the RCD and the latch 102 may be actuated to secure the oilfield equipment 104 with the latch member 116.

Figure 11:
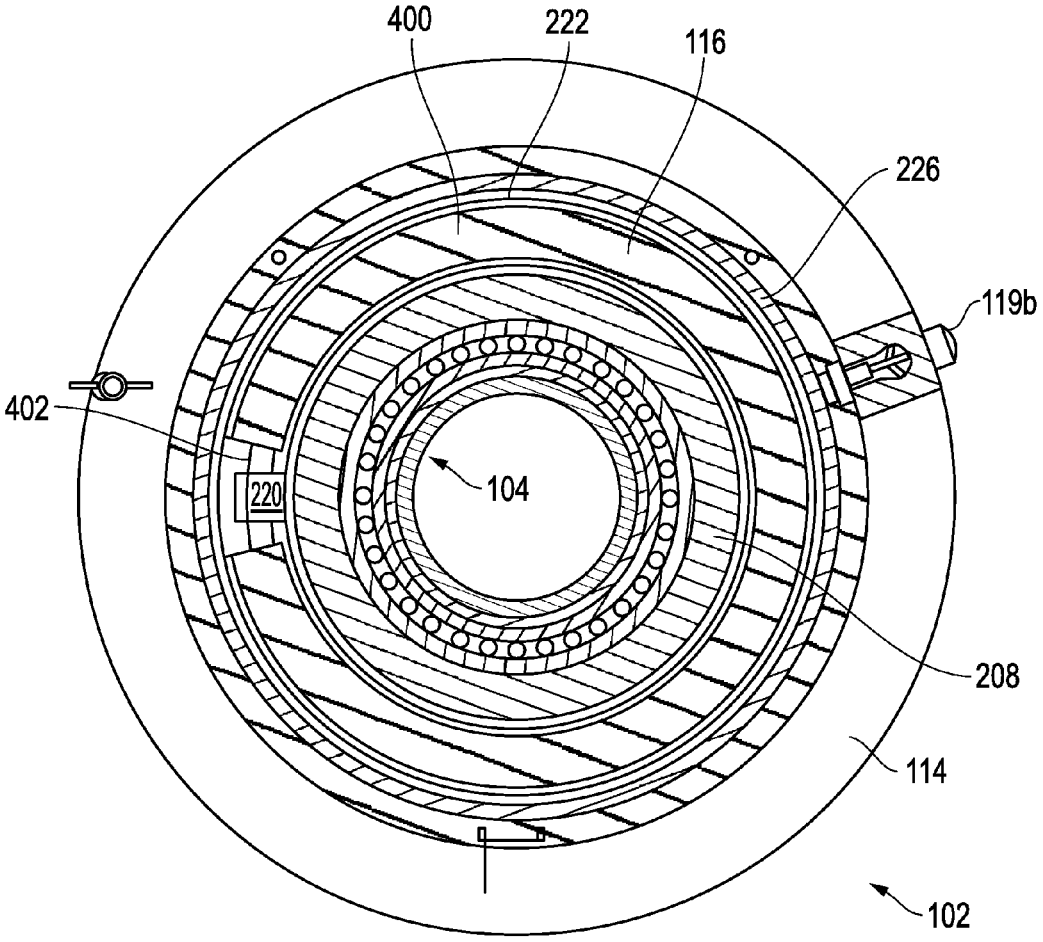
FIG. 11 depicts a cross-sectional top view of the latch disengaged according to an embodiment.

FIG. 11 depicts a cross-sectional top view of the latch 102 having the C-ring 400 latch member 116 in the disengaged position. The oilfield equipment 104 is shown placed in the housing 114 for latching to the latch 102. A portion of the disengagement actuator 226 is shown surrounding the latch member 116. The sensor 119*b* monitors the location of the disengagement actuator 226 as it travels in the actuator cavity 222.

Figure 12:
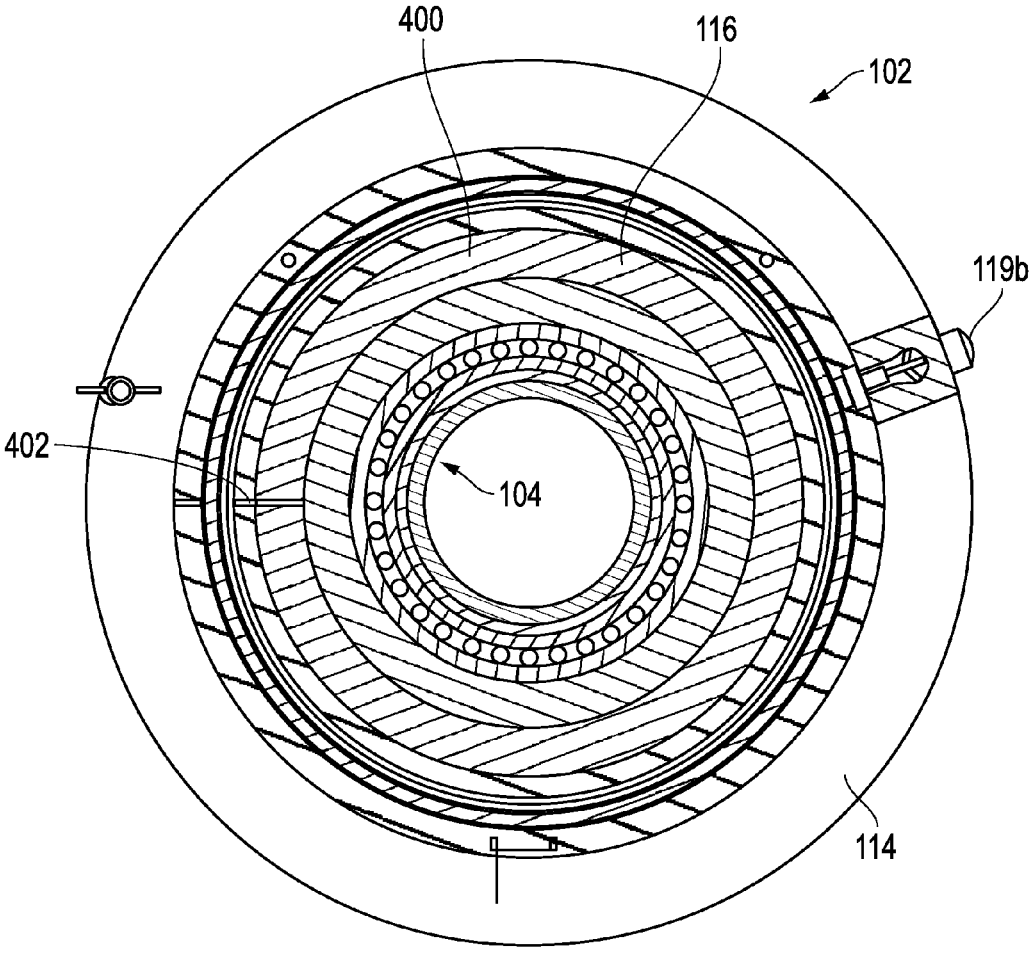
FIG. 12 depicts a cross-sectional top view of the latch engaged according to an embodiment.

FIG. 12 depicts the cross-sectional top view of the latch 102 as shown in FIG. 11 having the C-ring 400 latch member 116 in the engaged position. As the engagement actuator 224 (shown in FIGS. 2-10) moves the latch member 116 radially inward, the gap 402 is closed and the oilfield equipment 104 is engaged by the latch 102. The sensor 119*b* may positively identify that the location of the disengagement actuator 226 and thereby the latch member 116.

Figure 13B:
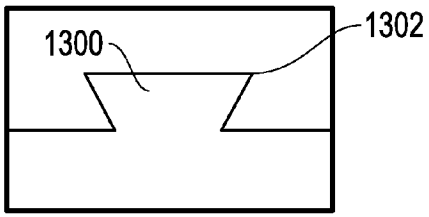
FIG. 13B depicts a view of the embodiment of FIG. 13A taken along line 13B-13B.
Figure 13A:
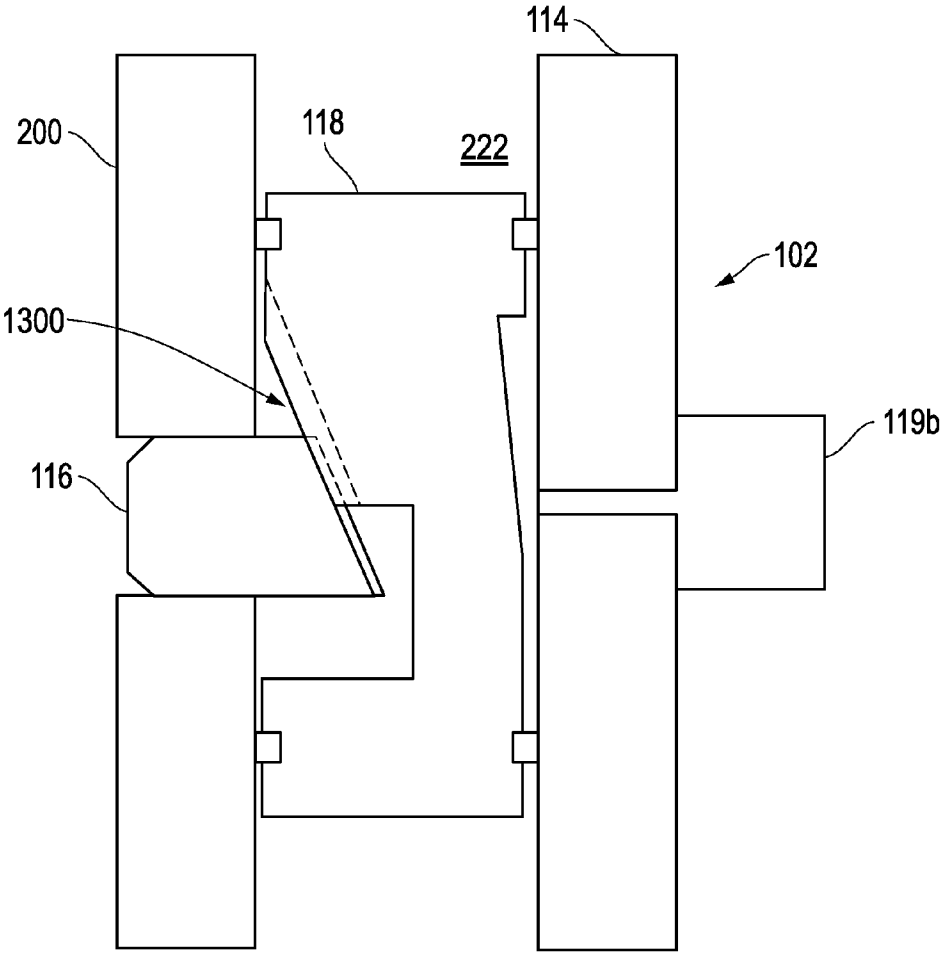
FIG. 13A depicts a schematic alternative embodiment of the latch.

FIGS. 13A and 13B represent an alternative embodiment of the latch 102 of FIG. 1. The latch 102 in this embodiment may have one actuator 118 configured to move the latch member 116 toward the engaged position and toward the disengaged position depending on the direction of travel of the actuator 118. The sensor 119*b* may determine the position of the actuator 118 as it travels in the actuator cavity 222. The interaction between the actuator 118, or piston, and the latch member 116, or locking dog, may have a dovetail arrangement 1300 (with angled ledges in a slot 1302) to move the latch member in and out. The actuator 118 and latch member 116 may be annular or there may be several actuators and/or latch members 116 for latching the oilfield equipment 104.

Figure 14:
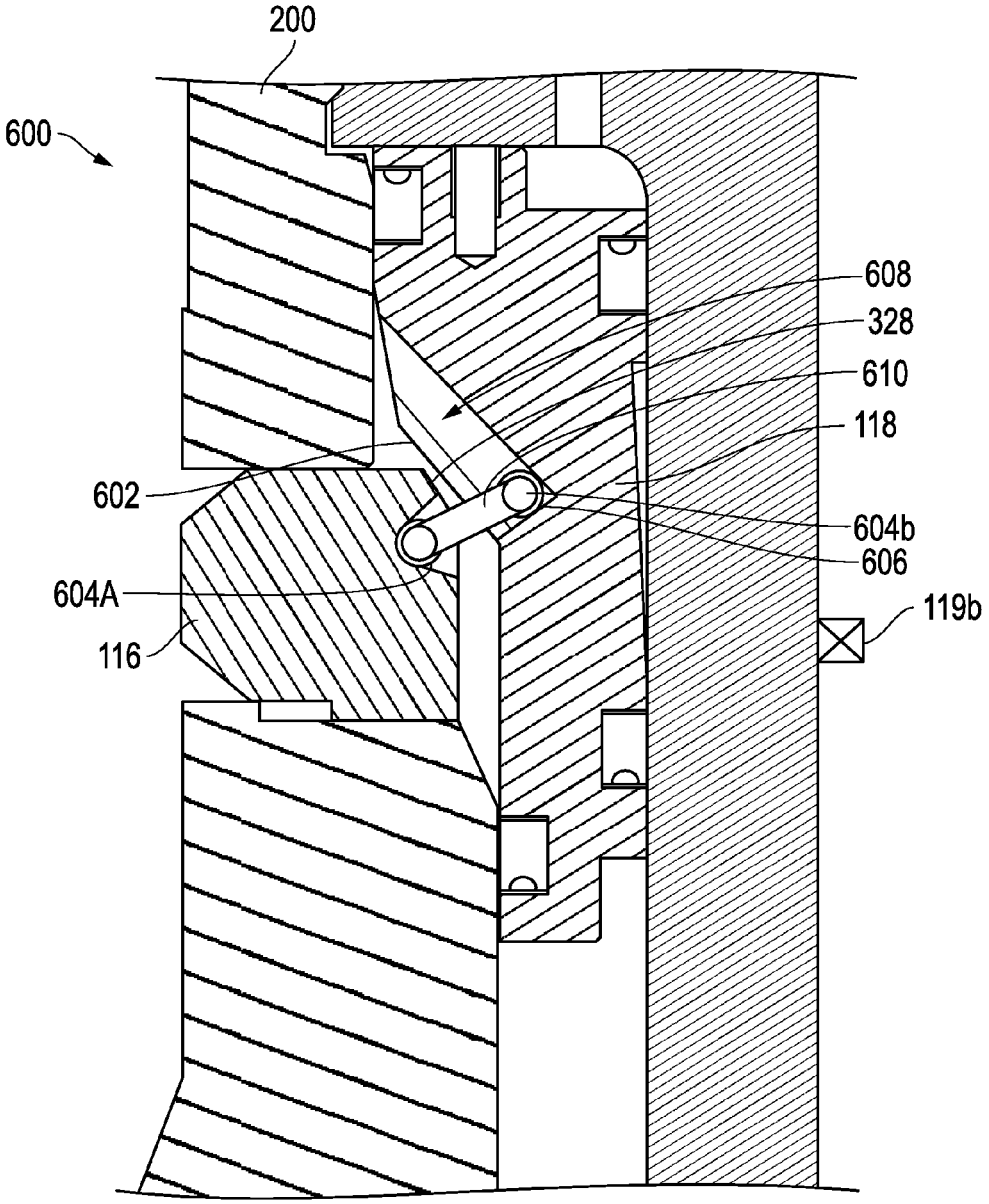
FIG. 14 depicts a cross-sectional view of a portion of the latch according to another embodiment.

In another embodiment shown in FIG. 14, the latch member(s) 116 may be driven by one piston that has a linkage system 600. Although not limited to, in this embodiment six to eight latch member(s) (locking dogs) 116 may be implemented and staggered circumferentially around the latch housing 200. The linkage system 600 may push the latch member 116 into the engaged position when the actuator 118 travels in a first direction, and may pull the latch member 116 toward the disengaged position when the actuator 118 travels in the opposite direction. In the embodiment shown, the linkage system 600 includes a link or follower arm 610 with pin connection 604*a* to the latch member 116. The link 610 has another pin connection 604*b* to an optional roller 606. The actuator may include a ramp(s) or interface(s) 602 to push the ramp(s) 328. Optionally, the actuator 118 has a groove 608. The groove 608 allows for movement of the roller 606 (if included) during operation. The actuator 118 may, for example, be hydraulically or pneumatically actuated. The linkage system 600 converts axial movement of the actuator 118 into radial movement of the latch 116 (e.g. when the actuator 118 is axially moved up in the embodiment shown the link 610 pulls the latch member 116 for retraction of the latch). If the groove 608 is eliminated, both pin connection points 604*a* and 604*b* are fixed and the ramp 602 could be eliminated (in which case the link 610 could actuate to latch and unlatch (i.e. both push and retract the latch member 116) and, further, in which case the link 610 could optionally be made to include some elasticity such as, for example, in a shock absorbing device).

Figure 16:
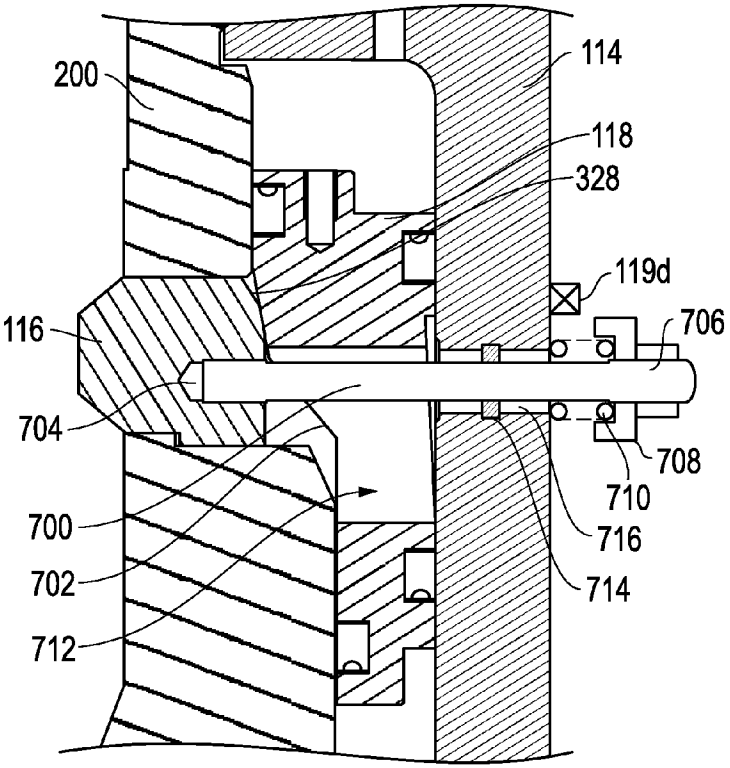
FIG. 16 depicts a cross-sectional view of a portion of the latch showing the latch in the engaged position according to another embodiment.
Figure 15:
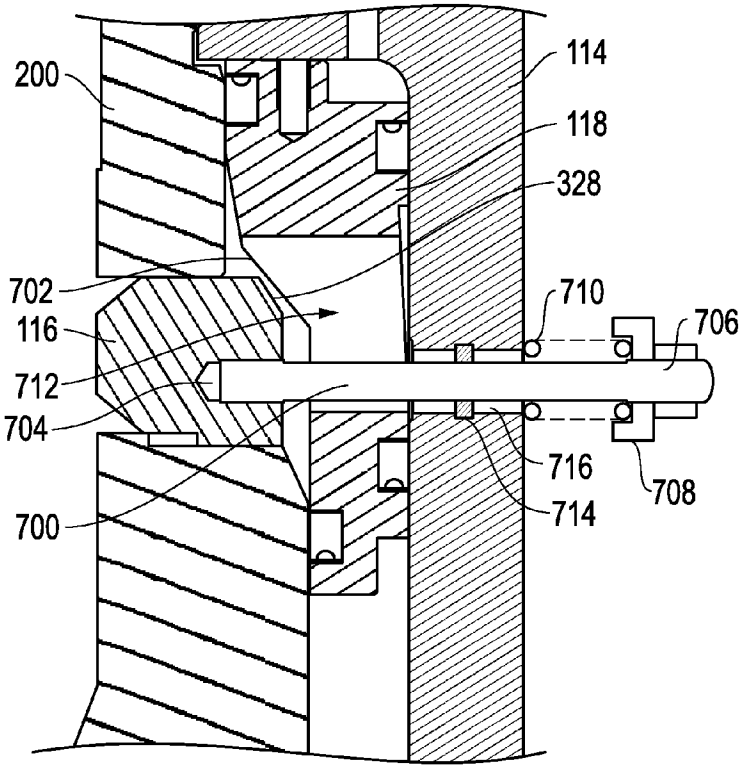
FIG. 15 depicts a cross-sectional view of a portion of the latch showing the latch in the disengaged position according to another embodiment.

In other embodiments, the latch member 116 may be radially driven between the engaged and disengaged position using one or more radial rod(s) 700. The radial rod(s) 700 may be built into the housing 114, or may protrude from the housing 114 in order to motivate the latch member 116. Although not limited to, in this embodiment six to eight latch member(s) (locking dogs) 116 may be implemented and staggered circumferentially around the latch housing 200. In the embodiment shown in FIGS. 15-16, the end 704 or the rod 700 is attached to the latch member 116 and the end 706 protrudes from the housing 114. A cap 708 is secured over the end 706 with a spring 710 mounted around the rod 700 between the cap 708 and the housing 114. The actuator 118 has a slot 712 to accommodate the rod 700 as the actuator 118 moves axially between housing 200 and housing 114. A seal or packing gland 714 is placed around the rod 700 in the channel 716 through the housing 114. The rod 700 may be biased (i.e. by the spring 710) to either retract or to engage via the latch member 116. The actuator 118 may, for example, be hydraulically or pneumatically actuated. The actuator 118 functions as a first actuator (piston) which moves the latch member 116 inward into the "latched" position via interaction of the ramp(s) or interface(s) 328 and 702. Next, as the actuator 118 is moved axially upward in the figure, the actuator 118 via or because of the slot 712 moves independently of (merely moves without direct causal effect on) the latch member 116. Then the biased rod 700 functions as a second actuator to physically move the latch member 116 to the retracted position. One variant for this embodiment is that the travel of the rod 700 projecting through the housing 114 can be directly detected by a sensing means 119*d* (i.e. detected by a sensor measuring position or distance, and/or visually inspected) in order to provide an indication of the travel or position of the latch member 116 (therefore, the position and/or travel of the latch member 116 is directly detected, i.e. not inferred via monitoring flow of a hydraulic fluid, etc.). Additionally, should the latch member 116 not retract fully, it would be possible to pull on the rod 700 in order to move the rod 700. The pull may be achieved by actuating an additional mechanical or hydraulic tool, e.g. piston (not shown), located on the outside of the housing 114, or may be performed manually by an operator. In another variation, the rod 700 may be actuated by a second actuator similar to disengagement actuator 226 (shown in FIG. 6) instead of by the spring 710. In another variation, the latch member 116 may be both latched and retracted by actuation of the rod 700 via a piston (radially) mounted exterior of the housing 114.

Figure 18:
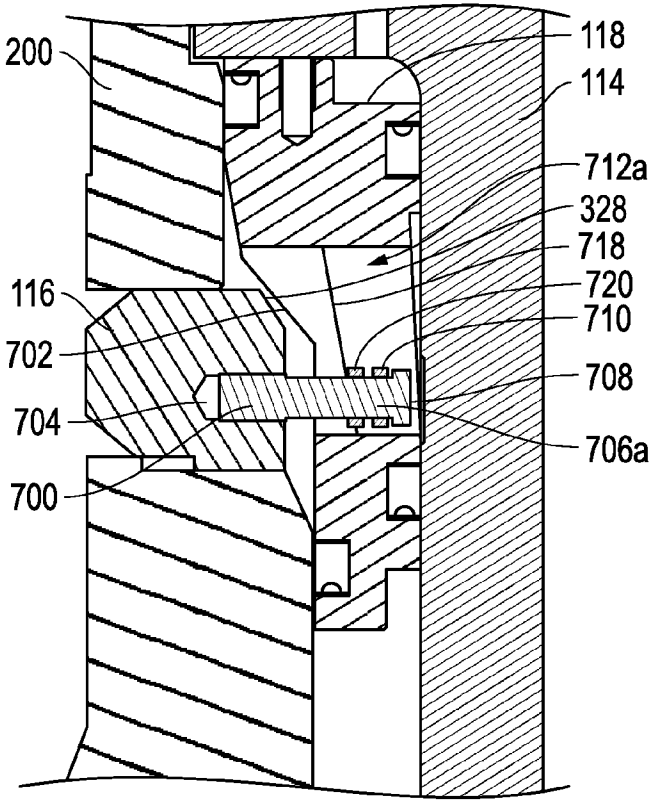
FIG. 18 depicts a cross-sectional view of a portion of the latch showing the latch in the disengaged position according to another embodiment.
Figure 17:
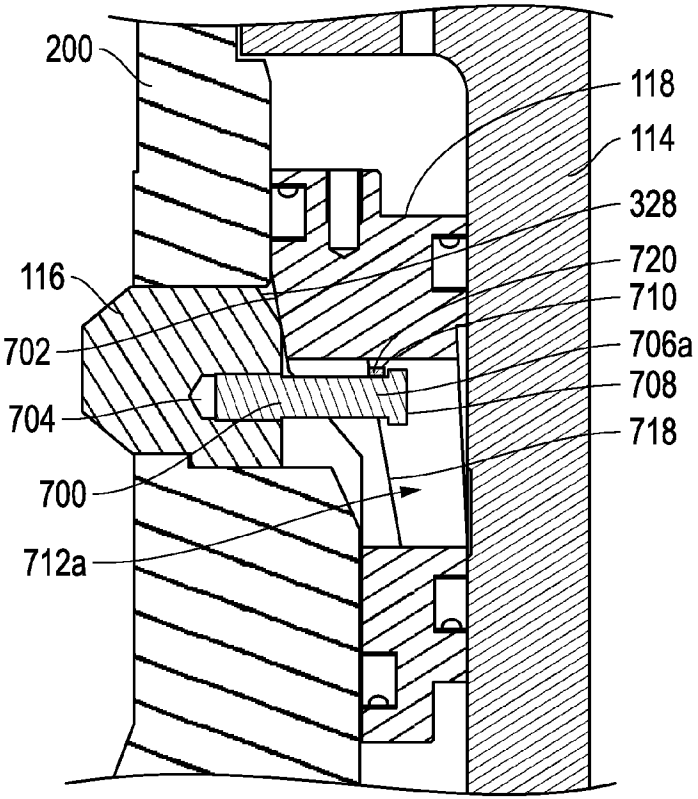
FIG. 17 depicts a cross-sectional view of a portion of the latch showing the latch in the engaged position according to another embodiment.

In the embodiment shown in FIGS. 17 and 18, the radial rod(s) 700 are shown built and fully contained within the housing 114. The end 704 or the rod 700 is attached to the latch member 116, and the end 706*a* is contained within from the housing 114. A carriage head 708 is secured or formed at the end 706*a* with a spring 710 mounted around the rod 700 between the carriage head 708 and the housing 114. The actuator 118 has a T-slot 712*a* including an angled ledge 718 to accommodate the carriage head 708 and rod 700 as the actuator 118 moves axially between housing 200 and housing 114. A sliding base (such as for example a washer) 720 may be placed around the rod 700 as part of the carriage head 708 and rides on the angled ledge 718. The rod 700 is biased (i.e. by the spring 710) to retract the latch member 116. The actuator 118 may, for example, be hydraulically or pneumatically actuated. The actuator 118 functions as a first actuator (piston) which moves the latch member 116 inward into the "latched" position (FIG. 17) via interaction of the ramp(s) or interface(s) 328 and 702. Next as the actuator 118 is moved axially upward in the figures, the actuator 118 via T-slot 712*a* merely moves without direct causal effect on the latch member 116. Then the biased rod 700 (via interaction between the carriage head 708, the angled ledge 718, the sliding base 720 and the spring 710) functions as a second actuator to physically move the latch member 116 to the retracted position. This embodiment alleviates the need to provide a seal 714 (FIGS. 15-16) between the housing 114 and the rod 700.

Figure 20:
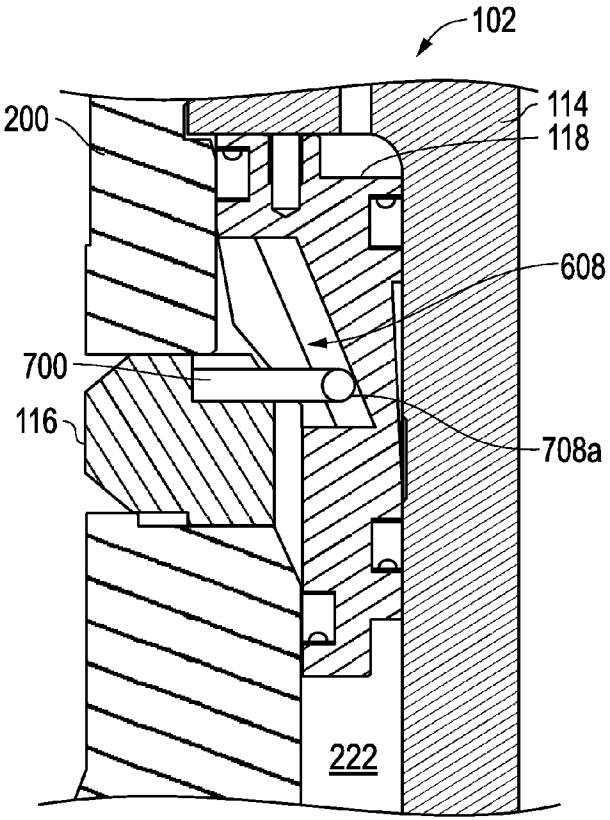
FIG. 20 depicts a cross-sectional view of a portion of the latch showing the latch in the disengaged position according to another embodiment.
Figure 19:
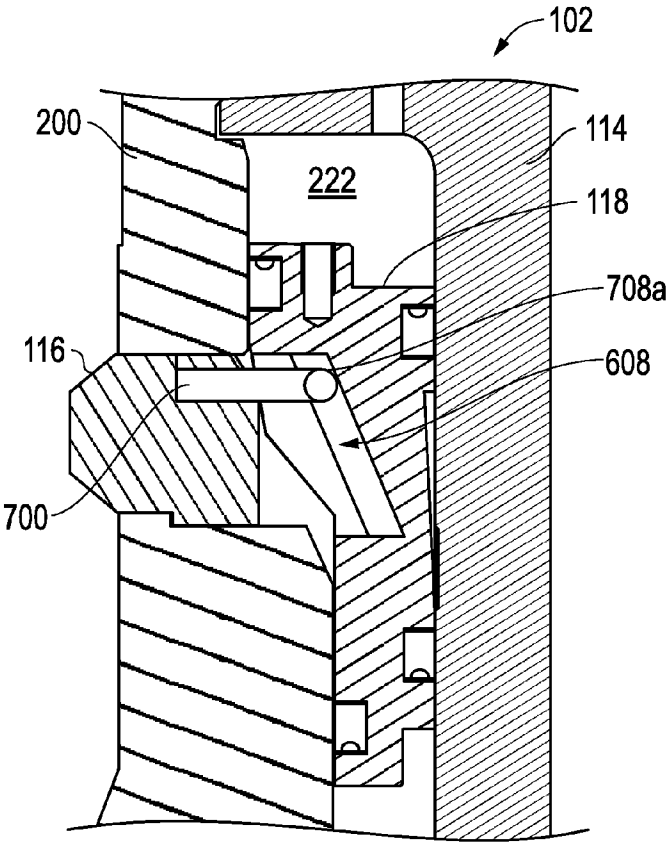
FIG. 19 depicts a cross-sectional view of a portion of the latch showing the latch in the engaged position according to another embodiment.

The embodiment shown in FIGS. 19 and 20 are similar to the embodiments shown in FIG. 13A except the dovetail arrangement 1300 is replaced by a rod 700 which rides in a T-slot or groove 608. The rod 700 may be configured as a carriage head 708*a* (such as for example in the form of a "T" shaped member or as a claw, and/or may be connected to a roller 606). Although not limited to, in this embodiment six to eight latch member(s) (locking dogs) 116 may be implemented and staggered circumferentially around the latch housing 200. The embodiment of FIGS. 19 and 20 converts axial movement of the actuator 118 into radial movement of the latch members 116 to both engage and retract the latch members 116.

Figure 21:
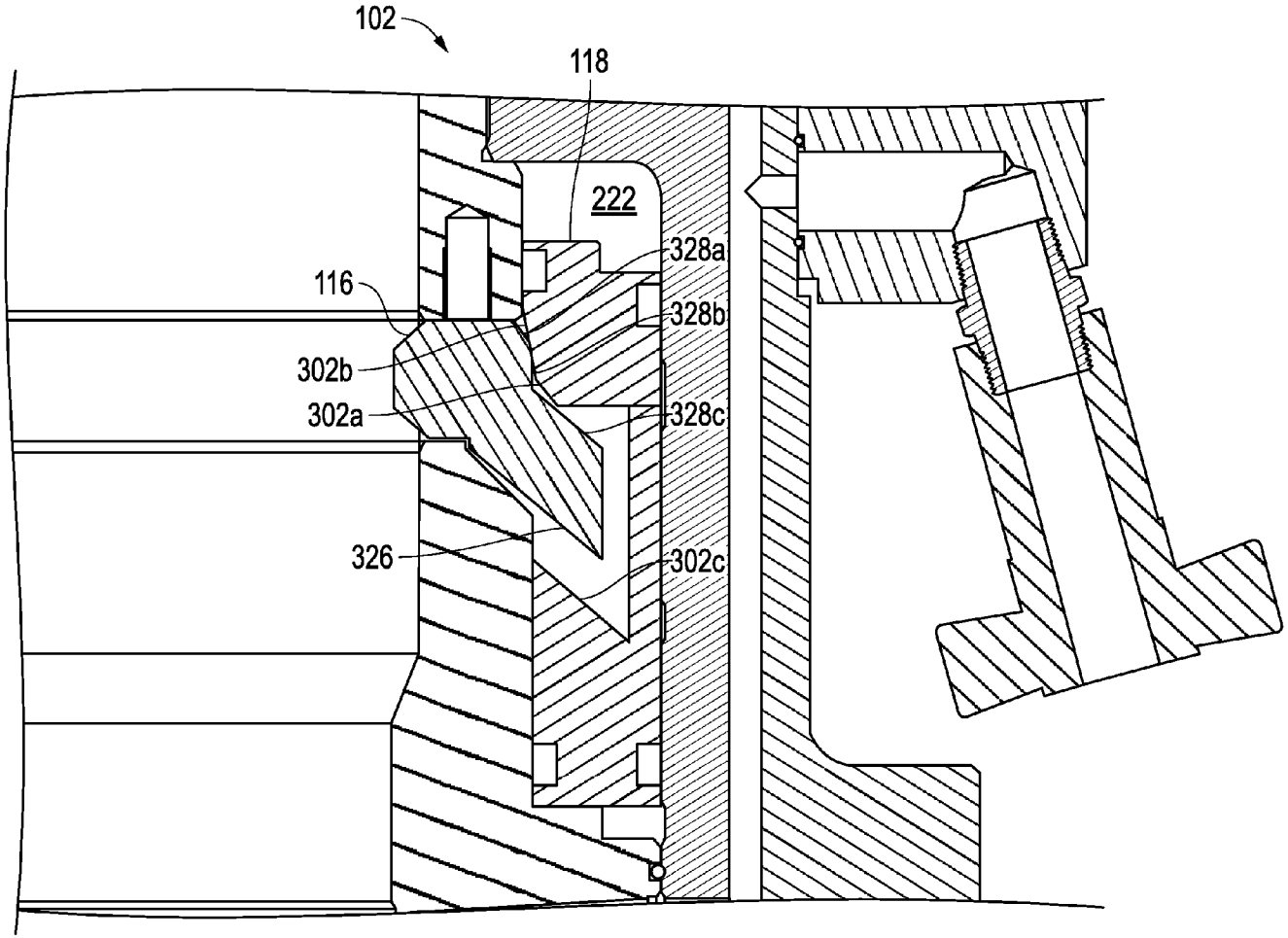
FIG. 21 depicts a cross-sectional view of a portion of the latch showing the latch in the engaged position according to another embodiment.
Figure 22:
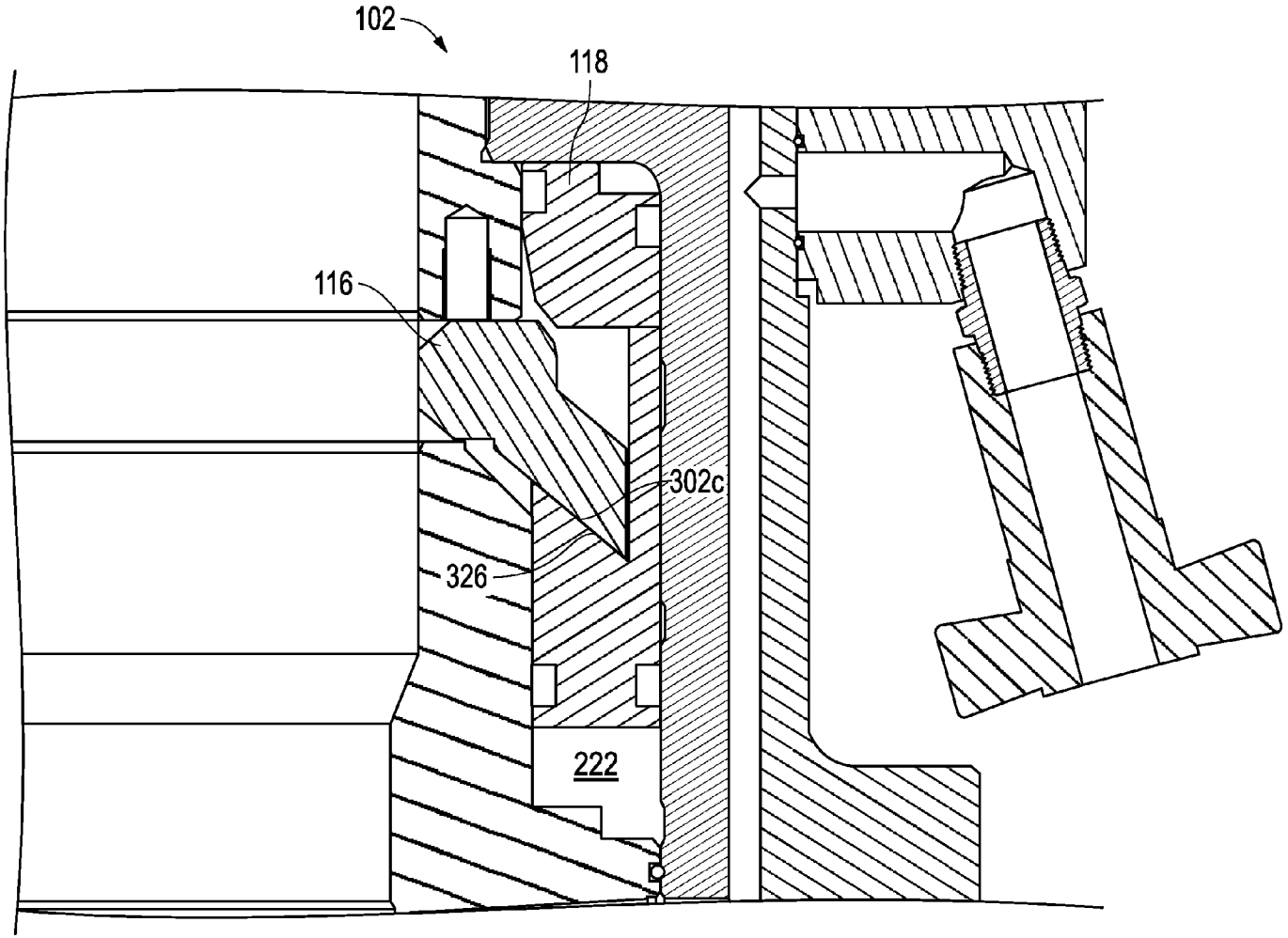
FIG. 22 depicts a cross-sectional view of a portion of the latch showing the latch in the disengaged position according to another embodiment.

The embodiment shown in FIGS. 21 and 22 is similar in form and function to the embodiment shown in FIGS. 3 and 6. An engagement actuator 224 and disengagement actuator 226 are shown. Engagement ramp(s) 328*a, b* & *c* along with ramp/interface(s) 302*a* & *b* are shown. The disengagement actuator 226 includes ramp/interface 302*c* whilst the latch member 116 includes disengagement ramp/interface 326.

Figure 23:
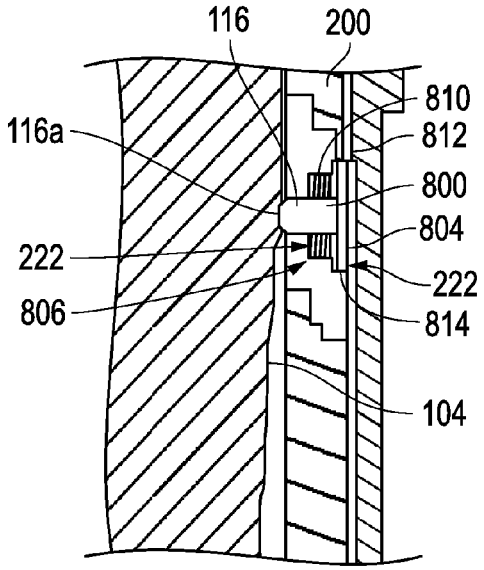
FIG. 23 depicts a cross-sectional view of a portion of the latch showing the latch in the engaged position according to another embodiment.

In the embodiment shown in FIG. 23 the latch member 116 may be radially driven between the engaged and disengaged position using one or more piston(s)/actuators 800. Each piston(s) 800 forms a unitary piston having combined or integrated a piston head 804 together with a rod/latch member 116. The unitary piston 800 may be mounted into a radial bore 806 in the housing 114 in order to motivate the latch member 116. Although not limited to, in this embodiment four to eight latch member(s) (locking dogs) 116 may be implemented and staggered circumferentially around the latch housing 200. A spring 810 (optionally together with wellbore pressure) may function as a second actuator to bias the latch member 116 to the unlatched position. Hydraulic or pneumatic pressure may be communicated to the bore 812 and sufficient pressure will overcome the force of the spring 810 (together with wellbore pressure) to force the piston 800 and therefore the latch member 116 into the latched position. As suggested, the latch member 116 is released by relieving the hydraulic or pneumatic pressure in the bore 812 until the force of the spring 810 (together with wellbore pressure, if any) retracts the latch member 116 to release the item of oilfield equipment 104. A seal 814 (e.g. an o-ring) may be mounted around the piston 800 to seal the actuator cavity 222. The base 116*a* of the latch member 116 is preferably rectangular.

Figure 24:
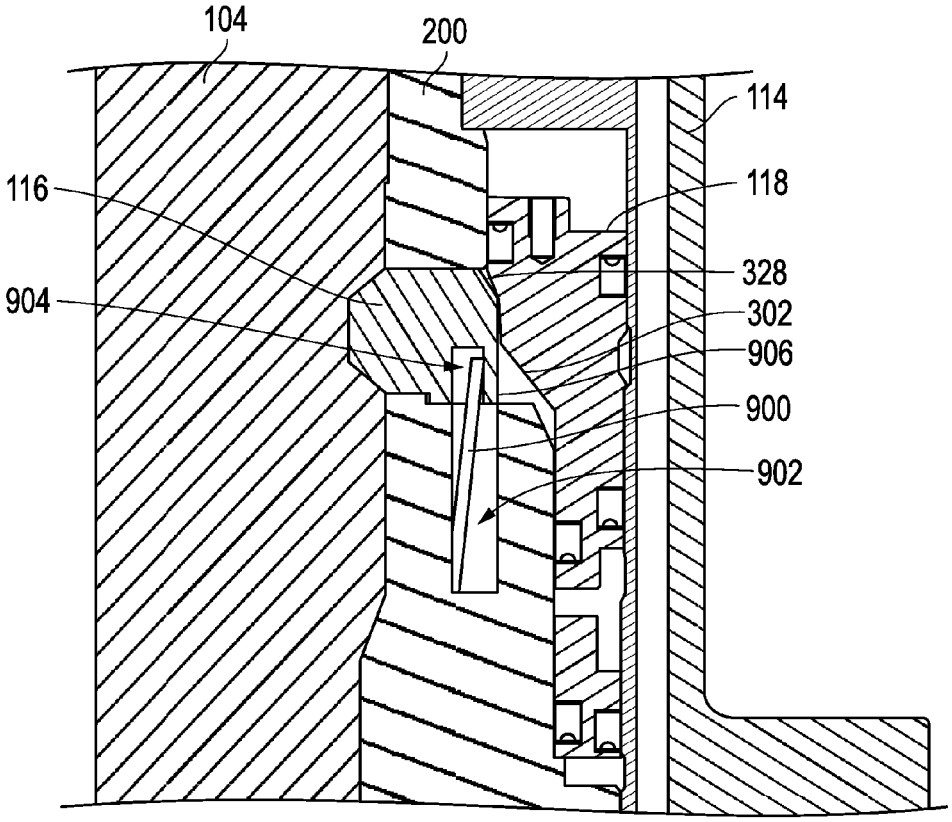
FIG. 24 depicts a cross-sectional view of a portion of the latch showing the latch in the engaged position according to another embodiment.

In the embodiment shown in FIG. 24, spring(s) 900 (such as, e.g., leaf spring arm(s)) are shown built and fully contained within the housing 200 and latch member(s) 116 in respective leaf spring pockets 902 and 904. Note that a shoulder 906 built into the latch member(s) defines the leaf spring pocket 904 in the latch member(s) 116. This embodiment could include multiple individual leaf spring arm(s) 900 or the leaf spring arm(s) 900 could be milled (e.g. five to sixteen leaf spring arm(s)) could be milled into a unitary annular leaf spring device). The latch member 116 is biased (i.e. by the spring(s) 900) to retract the latch member 116. The actuator 118 may, for example, be hydraulically or pneumatically actuated. The actuator 118 functions as a first actuator (piston) which moves the latch member 116 inward into the "latched" position (as represented in FIG. 24) via interaction of the ramp(s) or interface(s) 328 and 302. Next, as the actuator 118 is moved axially upward in the figure, the force of the actuator 118 is removed from outer circumference of the latch member 116. Then, the biased spring(s) 900 (via interaction between the respective leaf spring pockets 902 and 904 as they correspond to housing 200 and latch member 116, and more specifically by forcing shoulder 906 of latch member 116 relative to housing 200) function as a second actuator to physically move the latch member 116 to the retracted position.

For each embodiment represented those having ordinary skill in the art may devise systems to fulfill various options, including, that the actuator 118 may be biased to an engaged position; the actuator may be biased to a disengaged position; the latch member(s) 116 may be biased to the latched position; and/or the latch member(s) 116 may be biased to the unlatched position.

The disclosure of U.S. patent application Ser. No. 12/643,093, published as US2010/0175882 is hereby incorporated by reference (see, e.g., FIG. 6A of that disclosure) for purposes of teaching and disclosing that three (for example) latch members in parallel could be implemented into a combination latching system.

Figure 25:
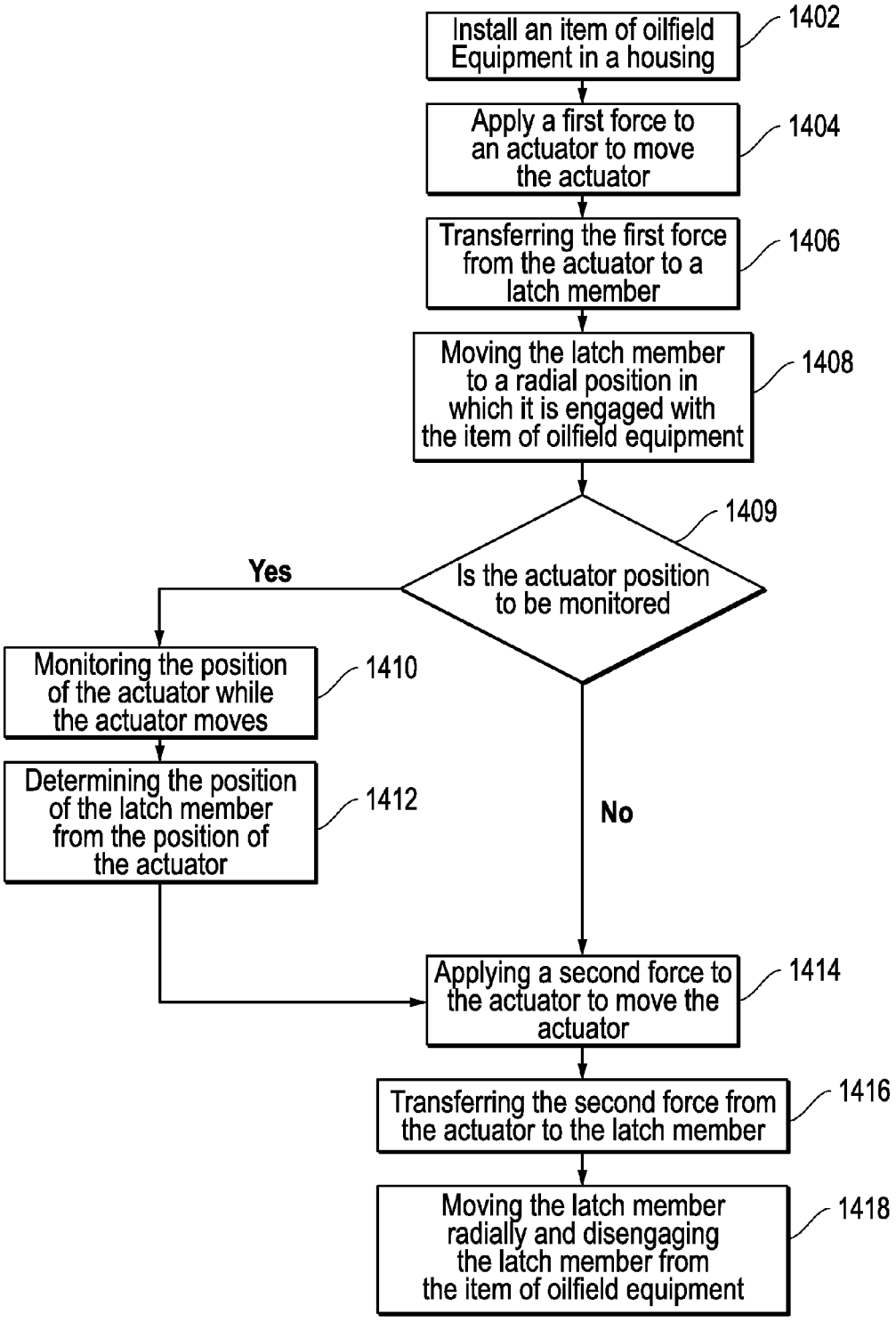
FIG. 25 depicts a method of using the latch.

FIG. 25 depicts a flow chart depicting a method of using the latch 102. The flow chart begins at block 1402 wherein an item of oilfield equipment 104 is installed into a housing. The flow chart continues at block 1404 wherein a first force is applied to an actuator 118 to move the actuator 118. The flow chart continues at block 1406 wherein the first force is transferred from the actuator 118 to a latch member 116. The flow chart continues at block 1408 wherein the latch member 116 is moved to a radial engaged position in which it is engaged with the item of oilfield equipment 104. The flow chart continues at block 1409 wherein it is determined if the position of the actuator is to be monitored. If the actuator position is to be monitored, the flow chart continues with the optional step shown at block 1410 wherein the position of the actuator 118 is monitored while the actuator moves. The position may be monitored during the movement of the latch radially inward and/or radially outward. The flow chart continues with the optional step shown at block 1412 wherein the position of the latch member 116 is determined from the position of the actuator 118. Regardless of whether or not the actuator position is to be monitored, the flow chart may continue at block 1414 wherein a second force is applied to the actuator 118 to move the actuator. The flow chart continues at block 1416 wherein the second force is transferred from the actuator 118 to the latch member 116. The flow chart continues at block 1418 wherein the latch member 118 is moved radially and disengaged from the item of oilfield equipment 104. Optionally during use of the latch 102, the controller 120 may prevent removal of the oilfield equipment while the latch member 118 is engaged with the item of oilfield equipment 104. The controller may actively prevent the removal of the oilfield equipment 104 thereby preventing inadvertent damage to the latch 102 and/or the oilfield equipment (for example, the controller may control a secondary drilling system for example by preventing the choke from being closed).

Figure 26:
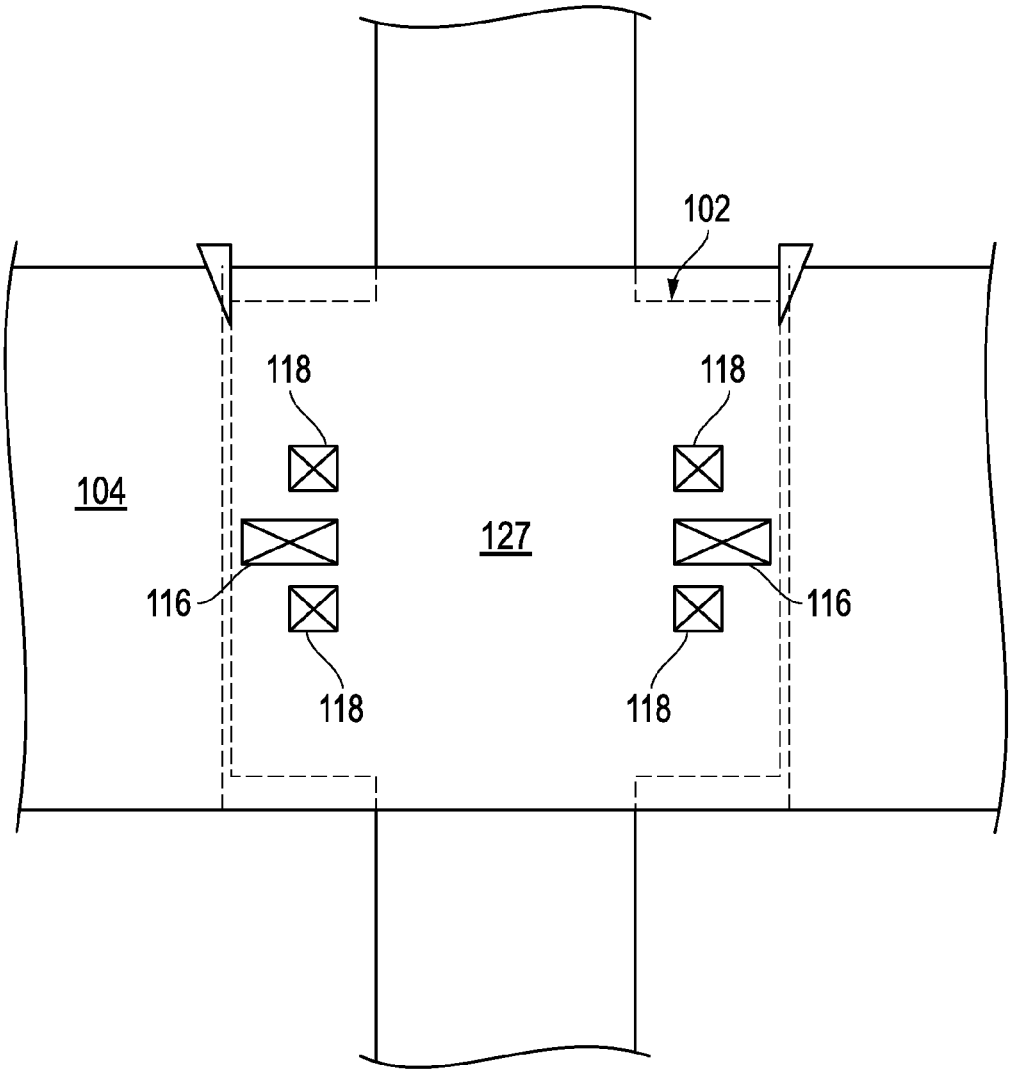
FIG. 26 depicts a schematic view of a portion of another embodiment of a wellsite.

FIG. 26 shows another embodiment of a latch 102 in which the actuator or actuators 118 causes the latch member 116 to move outward to engage the item of oilfield equipment 104 to be engaged, and to move inward to retract the latch member 116. The above more specific embodiments for engaging and retracting may be implemented to achieve this more schematic embodiment. In the schematic embodiment of FIG. 26, the latch member 116 and actuator(s) 118 are mounted to an inner item of oilfield equipage 127 for selectively engaging an outer item of oilfield equipment 104.

While the embodiments are described with reference to various implementations and exploitations, it will be understood that these embodiments are illustrative and that the scope of the inventive subject matter is not limited to them. Many variations, modifications, additions and improvements are possible. For example, the implementations and techniques used herein may be applied to any latch member at the wellsite, such as the BOP and the like.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An apparatus for latching an item of oilfield equipment comprising:

a housing;

a latch member contained within the housing, the latch member movable between a radially engaged position in which the latch member is engaged with the item of oilfield equipment, and a radially retracted position in which the latch member is disengaged from the item of oilfield equipment;

an actuator configured to drive the latch member into the radially engaged position, wherein the actuator is configured to drive the latch member toward the radially retracted position;

wherein the actuator comprises a radial rod attached at one end to the latch member, and a spring mounted on the radial rod;

wherein the latch member is driven into the radially engaged position by impact at a first contiguous interface between the actuator and the latch member; and wherein the latch member is driven into the radially retracted position by the spring biasing the radial rod and the latch member away from the housing.

2. The apparatus of claim 1, wherein the housing has a channel;

wherein the radial rod passes through the channel and protrudes from the housing; and wherein a seal is mounted in the channel between the housing and the radial rod.

3. The apparatus of claim 1, wherein the spring mounted on the radial rod is biased between the housing and a cap located at the other end of the radial rod.

4. An apparatus for latching an item of oilfield equipment comprising:

a housing;

a latch member contained within the housing, the latch member movable between a radially engaged position in which the latch member is engaged with the item of oilfield equipment, and a radially retracted position in which the latch member is disengaged from the item of oilfield equipment;

an actuator configured to drive the latch member into the radially engaged position, wherein the actuator is configured to drive the latch member toward the radially retracted position;

wherein the actuator has a ledge within a slot defined radially through the actuator;

wherein the actuator further comprises a radial rod attached at one end to the latch member, and a carriage head located at the other end of the radial rod; and wherein the latch member is driven into the radially retracted position by the carriage head riding on the ledge as the actuator is driven in an axial direction.

5. An apparatus for latching an item of oilfield equipment comprising:

a housing;

a latch member contained within the housing, the latch member movable between a radially engaged position in which the latch member is engaged with the item of oilfield equipment, and a radially retracted position in which the latch member is disengaged from the item of oilfield equipment;

an actuator configured to drive the latch member into the radially engaged position, wherein the actuator is configured to drive the latch member toward the radially retracted position;

wherein the actuator has a ledge within a slot defined in the actuator;

wherein the actuator further comprises a dovetail arrangement located at one end to the latch member; and wherein the latch member is driven into the radially retracted position by the dovetail arrangement riding on the ledge as the actuator is driven in an axial direction.

6. An apparatus for latching an item of oilfield equipment comprising:

a housing;

a latch member contained within the housing, the latch member movable between a radially engaged position in which the latch member is engaged with the item of oilfield equipment, and a radially retracted position in which the latch member is disengaged from the item of oilfield equipment;

an actuator configured to drive the latch member into the radially engaged position, wherein the actuator is configured to drive the latch member toward the radially retracted position;

wherein the latch member and the actuator together form a unitary piston;

wherein the unitary piston has a piston head;

wherein the housing defines a radial bore; and wherein a spring is mounted in the radial bore between the piston head and the housing.

7. An apparatus for latching an item of oilfield equipment comprising:

a housing;

a latch member contained within the housing, the latch member movable between a radially engaged position in which the latch member is engaged with the item of oilfield equipment, and a radially retracted position in which the latch member is disengaged from the item of oilfield equipment;

an actuator configured to drive the latch member into the radially engaged position, wherein the actuator is configured to drive the latch member toward the radially retracted position;

wherein the latch member has a shoulder;

wherein the actuator further comprises a leaf spring arm biased between the housing and the shoulder;

wherein the latch member is driven into the radially engaged position by impact at a first contiguous interface between the actuator and the latch member; and wherein the latch member is driven into the radially retracted position by the leaf spring arm biasing the shoulder and the latch member away from the housing.

8. An apparatus for latching an item of oilfield equipment comprising:

a housing;

a latch member contained within the housing, the latch member movable between a radially engaged position in which the latch member is engaged with the item of oilfield equipment, and a radially retracted position in which the latch member is disengaged from the item of oilfield equipment;

an actuator configured to drive the latch member into the radially engaged position, wherein the actuator is configured to drive the latch member toward the radially retracted position;

wherein the housing defines a slot, wherein the slot is defined in a position selected from the group consisting of above the latch member, below the latch member, and above and below the latch member, and wherein the slot is configured to remove an amount of debris or a volume of fluid or both.

9. An apparatus for latching an item of oilfield equipment comprising:

a housing;

a latch member contained within the housing, the latch member movable between a radially engaged position in which the latch member is engaged with the item of oilfield equipment, and a radially retracted position in which the latch member is disengaged from the item of oilfield equipment;

an actuator configured to drive the latch member into the radially engaged position, wherein the actuator is configured to drive the latch member toward the radially retracted position;

wherein the latch member further comprises a radial rod protruding from one end of the latch member, and a spring mounted on the radial rod;

wherein the latch member is driven into the radially engaged position by impact at a first contiguous interface between the actuator and the latch member; and wherein the latch member is driven into the radially retracted position by the spring biasing the radial rod and the latch member away from the housing.

10. An apparatus for latching an item of oilfield equipment comprising:

a housing;

a latch member contained within the housing, wherein the latch member is movable between a radially engaged position in which the latch member is engaged with the item of oilfield equipment and a radially retracted position in which the latch member is disengaged from the item of oilfield equipment; and an actuator connected to the latch member, wherein the actuator is configured to convert axial movement of the actuator to radial movement of the latch member, wherein the actuator is connected to the latch member with a dovetail arrangement having angled ledges on the latch member, and wherein the dovetail arrangement is inserted in a slot on the actuator.

11. The apparatus of claim 10, wherein the latch member moves toward the radially retracted position through relative sliding movement with the actuator.

12. The apparatus of claim 10, further comprising a spring between the latch member and the actuator, wherein the spring is configured to bias the latch member towards the radially retracted position.

* * * * *